US006585501B2

(12) United States Patent
Takeuchi et al.

(10) Patent No.: US 6,585,501 B2
(45) Date of Patent: Jul. 1, 2003

(54) SCROLL COMPRESSOR SEALING

(75) Inventors: Makoto Takeuchi, Nagoya (JP); Takahide Itoh, Nagoya (JP); Yasuharu Maruiwa, Nagoya (JP); Hiroshi Yamazaki, Nagoya (JP); Takayuki Hagita, Nagoya (JP); Tetsuzou Ukai, Nishi-kasugai-gun (JP); Katsuhiro Fujita, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/985,493

(22) Filed: Nov. 5, 2001

(65) Prior Publication Data

US 2002/0054821 A1 May 9, 2002

(30) Foreign Application Priority Data

| | | |
|---|---|---|
| Nov. 6, 2000 | (JP) | 2000-337995 |
| Feb. 2, 2001 | (JP) | 2001-026925 |
| Oct. 12, 2001 | (JP) | 2001-316033 |

(51) Int. Cl.[7] ..... F04C 18/04; F04C 27/00
(52) U.S. Cl. ..... 418/55.2; 418/55.4
(58) Field of Search ..... 418/55.2, 55.4

(56) References Cited

U.S. PATENT DOCUMENTS

| | | | | |
|---|---|---|---|---|
| 4,477,238 A | * | 10/1984 | Terauchi | 418/55.2 |
| 6,244,840 B1 | | 6/2001 | Takeuchi et al. | 418/55.2 |
| 6,287,097 B1 | | 9/2001 | Takeuchi et al. | 418/55.5 |
| 6,334,764 B1 | | 1/2002 | Kobayashi et al. | 418/55.4 |

FOREIGN PATENT DOCUMENTS

| | | |
|---|---|---|
| JP | 58030494 | 2/1983 |
| JP | 6010857 | 1/1994 |
| JP | 8028461 | 1/1996 |
| JP | 2002-5046 | 1/2002 |
| JP | 2002-5052 | 1/2002 |
| JP | 2002-5053 | 1/2002 |
| JP | 2002-5054 | 1/2002 |
| JP | 2002-5058 | 1/2002 |
| WO | WO 01/98661 | 12/2001 |
| WO | WO 01/98662 | 12/2001 |

* cited by examiner

*Primary Examiner*—John J. Vrablik
(74) *Attorney, Agent, or Firm*—Oblon, Spivak, McClelland, Maier & Neustadt, P.C.

(57) ABSTRACT

A scroll compressor including a fixed scroll having a spiral-shaped wall body, and a swiveling scroll which has a spiral-shaped wall body and revolves while linking together the two wall bodies. The wall bodies have steps, and side faces of two end plates have high and low bottom faces in correspondence with the steps. A tip seal is provided along a join edge which connects top edges on different sides of each step, and a mechanism is provided therebetween to prevent the tip seals from becoming removed from the join edges. Furthermore, in the same scroll compressor, tip seals are provided respectively in two grooves, and join paths are provided respectively between a high-pressure compression chamber, which is formed with the bottom faces as one section, and the two grooves. The pressure inside the high-pressure compression chamber is used as a pressing force for the tip seals.

8 Claims, 18 Drawing Sheets

Ll
C
Ll+Ls
2
Ls

Ll
C
Ls

Ll
C
Ls

Ll
C
Ls

C
Ls

SCROLL COMPRESSOR SEALING

BACKGROUND OF THE INVENTION

1. Field of the Invention

The present invention relates to a scroll compressor which is installed in an air conditioner, a refrigerator, or the like.

2. Description of the Related Art

In conventional scroll compressors, a fixed scroll and a swiveling scroll are provided by engaging their spiral wall bodies, and fluid inside a compression chamber, formed between the wall bodies, is compressed by gradually reducing the capacity of the compression chamber as the swiveling scroll revolves around the fixed scroll.

The compression ratio in design of the scroll compressor is the ratio of the maximum capacity of the compression chamber (the capacity at the point when the compression chamber is formed by the meshing of the wall bodies) to the minimum capacity of the compression chamber (the capacity immediately before the wall bodies become unmeshed and the compression chamber disappears), and is expressed by the following equation (I).

$$Vi=\{A(\theta_{suc})\cdot L\}/\{A(\theta_{top})\cdot L\}=A(\theta_{suc})/A(\theta_{top}) \quad \text{(I)}$$

In equation (I), $A(\theta)$ is a function expressing the cross-sectional area parallel to the rotation face of the compression chamber which alters the capacity in accordance with the rotating angle $\theta$ of the swiveling scroll; $\theta_{suc}$ is the rotating angle of the swiveling scroll when the compression chamber reaches its maximum capacity, $\theta_{top}$ is the rotating angle of the swiveling scroll when the compression chamber reaches its minimum capacity, and L is the wrap (overlap) length of the wall bodies.

Conventionally, in order to increase the compression ratio Vi of the scroll compressor, the number of windings of the wall bodies of the both scrolls is increased to increase the cross-sectional area $A(\theta)$ of the compression chamber at maximum capacity. However, in the conventional method of increasing the number of windings of the wall bodies, the external shape of the scrolls is enlarged, increasing the size of the compressor; for this reason, it is difficult to use this method in an air conditioner for vehicles and the like which have strict size restrictions.

In an attempt to solve the above problems, Japanese Examined Patent Application, Second Publication, No. Sho 60-17956 (Japanese Unexamined Patent Application, First Publication, No. Sho 58-30494) proposes a scroll compressor in which the spiral top edge of each wall of a fixed scroll and a swiveling scrollwall body have a low center side and a high outer peripheral side to form a step, and the side faces of the end plates of both scrolls have high center sides and low outer peripheral sides in correspondence with the step of the top edge.

In the scroll compressor as described above, when the wrap length of the compression chamber at maximum capacity is expressed as Ll and the wrap length of the compression chamber at minimum capacity is expressed as Ls, the compression ratio Vi' for design purposes is expressed by the following equation (II).

$$Vi'=\{A(\theta_{suc})\cdot Ll\}/\{A(\theta_{top})\cdot Ls\} \quad \text{(II)}$$

In equation (II), the wrap length Ll of the compression chamber at maximum capacity is greater than the wrap length Ls of the compression chamber at minimum capacity, so that Ll/Ls>1. Therefore, the compression ratio in design can be increased without increasing the number of windings of the wall bodies.

The scroll compressor which uses scrolls having steps as described above has a problem of airtightness when a join edge, which joins the low top edge and high top edge of the wall bodies, slides against a join wall face, which joins the deep side face and the shallow side face of the end plate.

For this reason, the scrolls are processed and assembled with extremely high precision in order to preserve airtightness when sliding the join wall faces together. However, the demand for extremely high-precision processing and assembly leads to poor productivity and higher costs.

To solve the above problems, Japanese Unexamined Patent Application, First Publication, No. Hei 6-10857 discloses a constitution in which a sealing member is provided on a join edge of the wall body of one scroll, and an energizing member is used to press the sealing member against the contact wall face of the end plate of the other scroll (see FIGS. 5 and 6).

In the above method, a sealing member is provided on the join edge of the wall body of one scroll and slides against the contact wall face of the side plate of the other scroll, enabling airtightness to be preserved without requiring high-precision processing. However, there is a problem that the sealing member may fall off when a gap appears between the join edge of the wall body and the join wall face of the end plate.

In order to solve the problem, Japanese Unexamined Patent Application, First Publication, No. Hei 8-28461 discloses a scroll compressor in which the sealing member, which is provided on the join edge of the wall body, is formed in one piece with the tip seal, which seals the upper top edge of the spiral-shaped wall body, thereby preserving airtightness and preventing the sealing member from falling off when the join wall faces are separated (see FIGS. 12 and 13).

However, the above method has the following problems. Although the tip seal and the sealing member of the join wall face are provided in one piece, since the sealing member is joined to the tip seal like a cantilever, the sealing member tends to break during long time operation.

Furthermore, in the conventional scroll compressor, the tip seal is provided along the spiral-shaped top edge of the wall body, preserving airtightness between the bottom faces of the scrolls and obtaining a compression chamber with negligible leakage, increasing the compression efficiency.

In the scroll compressor using a step in the scroll as described above, the tip seal is separated by the top edge of the stepped wall body, however, in the tip seal positioned on the outer peripheral side of the scroll, sufficient pressing force cannot be achieved against the top edge of the wall bodies due to low pressure against the rear faces thereof, and the tip seal cannot function properly as a seal. When there is considerable leakage from the compression chamber, an equivalent dynamic force is needed for recompression and dynamic force loss of the driving power is incurred; this is is not efficient.

BRIEF SUMMARY OF THE INVENTION

In view of the above problems, it is an object of the present invention to provide a highly reliable scroll compressor which prevents leakage of fluid to be transported by increasing the airtightness between a fixed scroll and a swiveling scroll, thereby increasing the compression ratio and increasing capability.

It is another object of the present invention, in a scroll compressor using a scroll having a step, to increase the seal function of a tip seal so as to reduce leakage from the compression chamber, and eliminate loss of power to be used as recompression power for the leakage, thereby increasing the operating efficiency of the compressor.

In order to achieve the above objects, the scroll compressor of the present invention has the following constitution.

A first aspect according to the present invention is to provide A scroll compressor comprising: a fixed scroll, which is fixed in position and has a spiral-shaped wall body on one side face of an end plate; a swiveling scroll, which has a spiral-shaped wall body on one side face of an end plate, being supported by engaging of the wall bodies so as to move revolution swiveling as it is prevented rotating; top edges of the wall bodies being divided at a plurality of points, the height at each point becoming low on the center side of the spiral direction and becoming high on the outer side, thereby forming a step; and one side face of the end plates similarly being divided at a plurality of points, the height at each point becoming high on the center side of the spiral direction and becoming low on the outer side, thereby forming a step in correspondence with each of the points; the scroll compressor comprising a sealing member being provided on a join edge which joins adjacent points on the top edges and sliding against a join wall face which joins adjacent points on the side faces of the end plates; and a sealing member holding unit which prevents the sealing member from falling off a scroll member.

In the above scroll compressor, airtightness with the join wall face is increased without a need for high-precision processing by providing the sealing member on the join edge. Therefore, the compression ratio and capability of the scroll compressor is increased. The join edge and the join wall face are not constantly sliding against each other, but slide against each other only during a half-rotation of the swiveling scroll; there is no sliding at any other time. Furthermore, the scroll compressor comprises a sealing member holding unit which stops the sealing member from falling off even when the sealing member (tip seal) is not sliding; the sealing member holding unit is obtained by, for example, burying the sealing member (tip seal) of the step deeper than the lower tip seal face, thereby increasing the reliability of smooth operation.

A second aspect of the present invention is to provide, in the scroll compressor according to the first aspect, the sealing member holding unit comprising a groove provided in the join edge; a filling section provided in the sealing member to be fitted into the groove; a narrower section provided at the opening of the groove and having a narrower width than the bottom section of the groove; and an enlarged section provided on the filling section and clipping into the narrower section so as to prevent the filling section from becoming removed from the groove.

In the above scroll compressor, the sealing member joined to the filling section is prevented from becoming separated from the groove even when the join edge and the join wall face are not sliding against each other, thereby increasing the reliability of smooth operation.

A third aspect of the present invention is to provide, in the scroll compressor according to the first aspect, the sealing member holding unit is a groove provided in the join edge, wherein the sealing member to be engaged in the groove connecting to at least one other sealing member which is engaged into the groove provided along each of the top edges, and engaging another end of the sealing member therein In the above scroll compressor, since the sealing member of the step section connects to the other sealing member, the other end of the sealing member is engaged even when the join edge and the join wall face are not sliding against each other, preventing a cantilever support of the sealing member. Therefore, the sealing member is prevented from falling out of the groove, increasing the reliability of smooth operation.

A fourth aspect of the present invention is to provide, in the scroll compressor according to the first aspect, the sealing member holding unit comprising a groove provided in the join edge; a concavity which connects to the groove; and a convexity provided on the sealing member which is engaged into the groove with movable space.

In the above scroll compressor, the convexity provided on the sealing member is freely moved within movable space in the concavity, so that the sealing member does not fall out from the groove, thereby increasing the reliability of smooth operation.

A fifth aspect of the present invention is to provide, in the scroll compressor according to the second, third, or fourth aspect, an elastic material for applying a pressing force in the direction of the separation of the sealing member, provided in the groove, from the join edge, is provided to the groove.

In the above scroll compressor, the elastic material is provided to the groove, pressing the sealing member against the join wall face when the join edge and the join wall face are sliding against each other. Since better airtightness is achieved, the capability of the compressor is further increased.

A sixth aspect of the present invention is to provide, in the scroll compressor according to the first aspect, the sealing member holding unit comprising an elastic material, which is provided between the sealing member and the scroll member and connects the two members together.

In the above scroll compressor, the elastic material is provided to the groove, pressing the sealing member against the join wall face when the join edge and the join wall face are sliding against each other. Since better airtightness of the step section is achieved, the capability of the compressor is further increased. Moreover, when the join edge and the join wall face are not sliding against each other, the elastic material secures the sealing member and the join edge, preventing the sealing member from falling out from the groove. The groove depth (g) is made longer than the natural length ($l_0$) of the elastic material ($g>l_0$).

A seventh aspect of the present invention is to provide, in the scroll compressor according to the first, second, third, or fourth aspect, the dimensions of the sealing member at the time of its formation being set so that the tip of the sealing member touches the side wall of another scroll member when assembled with the other scroll member.

In the above scroll compressor, when the join edge and join wall face slide against each other, the sealing member holding unit in the scroll compressor according to the first, second, third, or fourth aspect is used, increasing the reliability of the compressor. Furthermore, since the dimensions of the sealing member at the time of its formation are set so that the tip of the sealing member touches the wall face (slide face) of the other scroll member when assembled, thereby increasing airtightness of the step during sliding.

An eighth aspect of the present invention is to provide, in the scroll compressor of any one of 1, 2, 3, 4, and 6th aspects, the sealing member comprising a polymer material.

In the above scroll compressor, since the sealing member comprises a polymer material, complex shapes can be manufactured with comparative ease.

A ninth aspect of the present invention is to provide, a scroll compressor comprising a fixed scroll, which is fixed in position and has a spiral-shaped wall body on one side face of an end plate; a swiveling scroll, which has a spiral-shaped wall body on one side face of an end plate, being supported by engaging of the wall bodies so as to move revolution swiveling as it is prevented rotating; top edges of the wall bodies being divided at a plurality of points, the height at each point being low on the center side of the spiral direction and being high on the outer side, thereby forming a step; one side face of the end plates similarly being divided at a plurality of points, the height at each point becoming high on the center side of the spiral direction and becoming low on the outer side, thereby forming a step in correspondence with each of the points; and a covering material, provided on a join wall face which joins adjacent points on a side face of each of the end plates, the covering material being worn away by the sliding of a join edge, which joins the adjacent points on the top edges.

In the above scroll compressor, the covering material starts wearing away from when the compressor starts operating, but some of the covering material remains in the gap between the join wall face and the join edge, enabling the join wall face to become accustomed to the join edge which rotates. Consequently, airtightness between the join edge and the join wall face is improved, further increasing the capability of the compressor.

A tenth aspect of the present invention is to provide a scroll compressor comprising a fixed scroll, which is fixed in position and has a spiral-shaped wall body on one side face of an end plate; a swiveling scroll, which has a spiral-shaped wall body on one side face of an end plate, being supported by engaging of the wall bodies so as to move revolution swiveling as it is prevented rotating; top edges of the wall bodies being divided at a plurality of points, the height at each point being low on the center side of the spiral direction and being high on the outer side, thereby forming a step; and one side face of the end plates similarly being divided at a plurality of points, the height at each point becoming high on the center side of the spiral direction and becoming low on the outer side, thereby forming a step in correspondence with each of the points; a join wall face, which joins adjacent points on a side face of each of the end plates, is separated from the end plate main body with a part of the end plate and can move in the spiral direction between adjacent wall bodies, the separated part of the end plate being pressed in the spiral direction by a pressing unit, provided between the separated part and the end plate main body.

In the above scroll compressor, one part of the separated end plate is pressed to the outside of the spiral direction by the pressing unit, pushing the join wall face against the join edge and thereby increasing airtightness. When the movable range of the part of the end plate is appropriately set, it is possible to push the join wall face against the join edge even while the join edge is not sliding against the join wall face. As a result, there is a high level of airtightness between the join edge and the join wall face, and they regularly slide against each other. Therefore, the capability of the scroll compressor is further increased.

An eleventh aspect of the present invention is to provide, in the scroll compressor of the tenth aspect, one of the end plate main body and the part of the end plate comprises a guide groove, provided along the spiral direction of the separated part of the end plate, and another of the end plate main body and the part of the end plate comprises a secured axial body, which is engaged into the guide groove and is allowed to move in the spiral direction within the guide groove.

In the above scroll compressor, the relationship between the guide groove and the axial body which is engaged therein with movable space specifies the movable range of the part of the separated end plate, enabling the part of the end plate to be led in that direction without obstruction, thereby ensuring that the compressor smoothly operates.

A twelfth aspect of the present invention is to provide a scroll compressor comprising a fixed scroll, which is fixed in position and has a spiral-shaped wall body on one side face of an end plate; a swiveling scroll, which has a spiral-shaped wall body on one side face of an end plate, being supported by engaging of the wall bodies so as to move revolution swiveling as it is prevented rotating; top edges of the wall bodies being divided at a plurality of points, the height at each point being low on the center side of the spiral direction and being high on the outer side, thereby forming a step; and one side face of the end plates similarly being divided at a plurality of points, the height at each point becoming high on the center side of the spiral direction and becoming low on the outer side, thereby forming a step in correspondence with each of the points; one or both of the fixed scroll and the swiveling scroll having a sealing member, provided along the points on the outer end side of the top edges of the wall bodies; and an inlet path which leads internal pressure of a compression chamber, formed by the points in the center side of side faces of the end plates, and a space which connects to the compression chamber, between the sealing member and the point on the outer end side of the top edges of the wall bodies.

In the above scroll compressor, the internal pressure of a compression chamber, formed by the points in the center side of side faces of the end plates, or a space (e.g. a discharge cavity or an oil chamber separated by an oil separator on the discharge side) which connects to the compression chamber, is led along an inlet path between the sealing member (a tip seal) and the point on the outer end side of the top edges of the wall bodies. Therefore, the internal pressure is much greater than in the compression chamber on the outer end side. The pressure increases the pushing force of the sealing member, enabling the sealing member to function adequately. Incidentally, a refrigerant or refrigerating machine oil can be used as the fluid which is led in order to transmit the internal pressure. Consequently, since leakage of the fluid from the compression chamber is prevented, there is no need for recompression power to compensate for the leaked fluid, eliminating power loss of the driving power and increasing the operating efficiency.

A thirteenth aspect of the present invention is to provided a scroll compressor comprising a fixed scroll, which is fixed in position and has a spiral-shaped wall body on one side face of an end plate; a swiveling scroll, which has a spiral-shaped wall body on one side face of an end plate, being supported by engaging of the wall bodies so as to move revolution swiveling as it is prevented rotating; top edges of the wall bodies being divided at a plurality of points, the height at each point being low on the center side of the spiral direction and being high on the outer side, thereby forming a step; and one side face of the end plates similarly being divided at a plurality of points, the height at each point becoming high on the center side of the spiral direction and becoming low on the outer side, thereby forming a step in correspondence with each of the points; wherein a groove is provided along the spiral direction on the top edges of each wall body; a sealing member, which slides to the plural points, is engaged in the groove; the groove connects a join edge joining the adjacent points on the top edges and further connects a concavity formed in the spiral direction from the join edge; and an end portion of the sealing member is engaged in the concavity.

In the above scroll compressor, since the end portion of the sealing member is embedded in the concavity on the scroll side, the sealing member is prevented from falling out of the groove even when the join edge and a join wall are separated each other, thereby increasing the reliability of smooth operation.

DETAILED DESCRIPTION OF THE INVENTION

A first embodiment of the scroll compressor according to the present invention will be explained with reference to FIGS. 1 to 9D.

Figure 1:
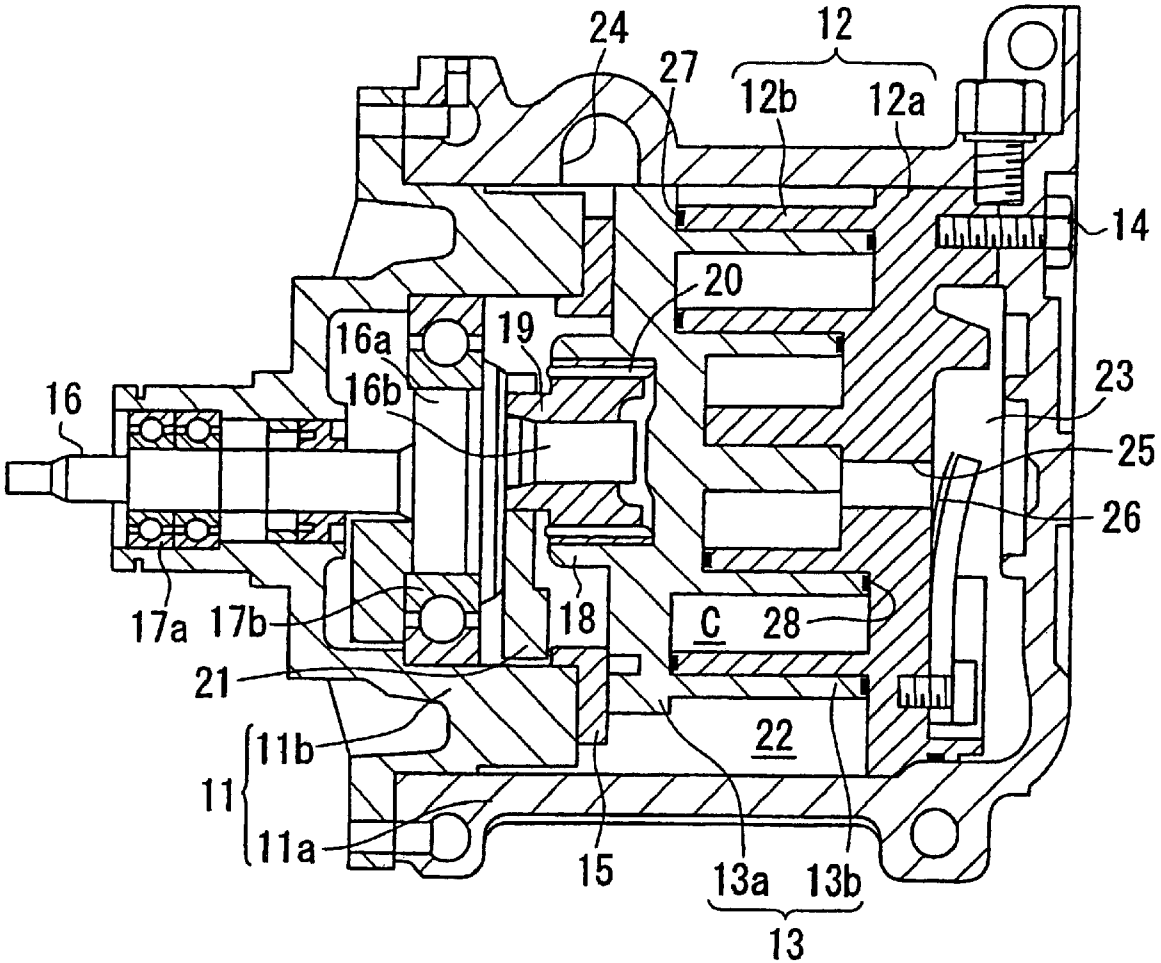
FIG. 1 is a side cross-sectional view of a first embodiment of the scroll compressor according to the present invention.

FIG. 1 is a cross-sectional view of the overall constitution of the scroll compressor according to the present invention. In FIG. 1, reference numeral 11 represents a housing comprising the cup-shaped housing main body 11*a* and the lid plate 11*b*, which is fixed to the open side of the housing main body 11*a*.

A scroll compressor mechanism comprises the fixed scroll 12 and the swiveling scroll 13, and is provided inside the housing 11. The fixed scroll 12 comprises a spiral wall body 12*b* provided on a side face of an end plate 12*a*. The swiveling scroll 13 similarly comprises the spiral wall body 13*b* provided on a side face of the end plate 13*a*, in particular, the wall body 13*b* being identical in shape to the wall body 12*b* of the fixed scroll 12. Tip seals 27 and 28 (explained later) for increasing the airtightness of a compression chamber C are provided on the top edges of the wall bodies 12*b* and 13*b*.

The bolt 14 secures the fixed scroll 12 to the housing main body 11*a*. The swiveling scroll 13 is eccentrically provided against the fixed scroll 12 by the revolution radius and is engaged to the fixed scroll 12 with a phase shift of 180 degrees by engaging the wall bodies 12*b* and 13*b*. Thereby, the swiveling scroll 13 is supported so as to be able to revolve with swiveling while being prevented from rotating around its own axis by the mechanism preventing rotation 15, which is provided between the lid plate 11*b* and the end plate 13*a*.

The rotating axis 16 having the crank 16*a* is inserted through the lid plate 11*b*, and is supported in the lid plate 11*b* via bearings 17*a* and 17*b* so as to rotate freely.

The boss 18 is provided so as to protrude from the center of the other end face of the end plate 13*a* of the swiveling scroll 13. The eccentric section 16*b* of the crank 16*a* is accommodated in the boss 18 via the bearing 19 and the drive bush 20 so as to freely rotate therein; the swiveling scroll 13 revolves with swiveling around the rotating axis 16 when the rotating axis 16 is rotated. The balance weight 21 is attached to the rotating axis 16, and cancels unbalance applied to the swiveling scroll 13.

The suction chamber 22 is provided around the periphery of the fixed scroll 12 inside the housing 11, and the discharge cavity 23 is provided by partitioning the inner bottom face of the housing main body 11*a* and the other side face of the end plate 12*a*.

The suction port 24 is provided in the housing main body 11*a*, and leads a low-pressure fluid toward the suction chamber 22. The discharge port 25 is provided in the center of the end plate 12*a* of the fixed scroll 12, and leads a high-pressure fluid from the compression chamber C, which has moved to the center while gradually decreasing in capacity, toward the discharge cavity 23. The discharge valve 26 is provided in the center of the other side face of the end plate 12*a*, and opens the discharge port 25 only when a pressure greater than a predetermined pressure is applied thereto.

Figure 2A:
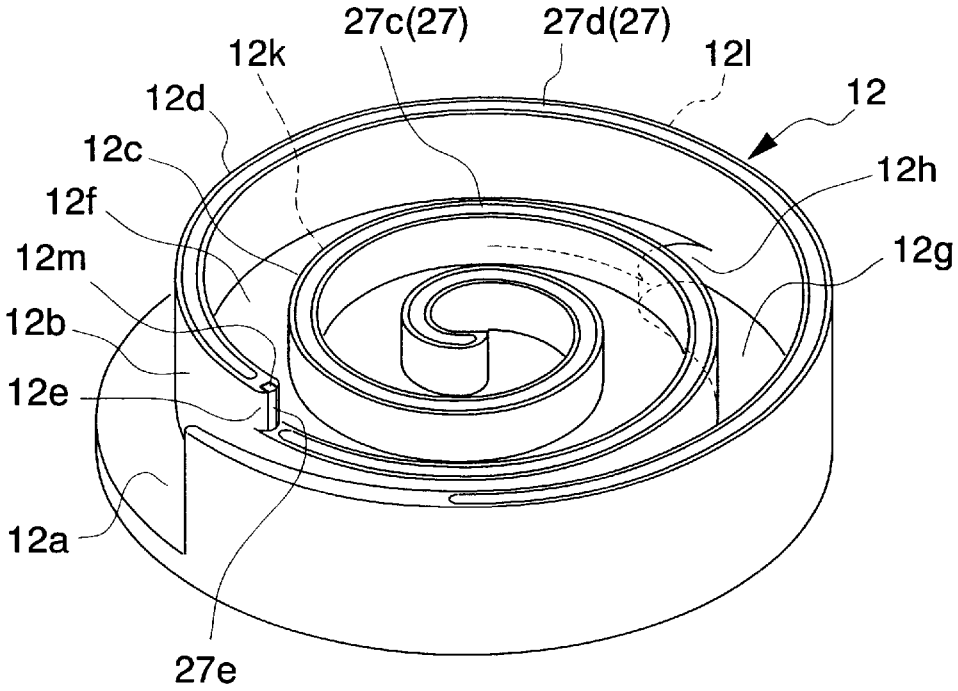
FIG. 2A is a perspective view of a fixed scroll.
Figure 2B:
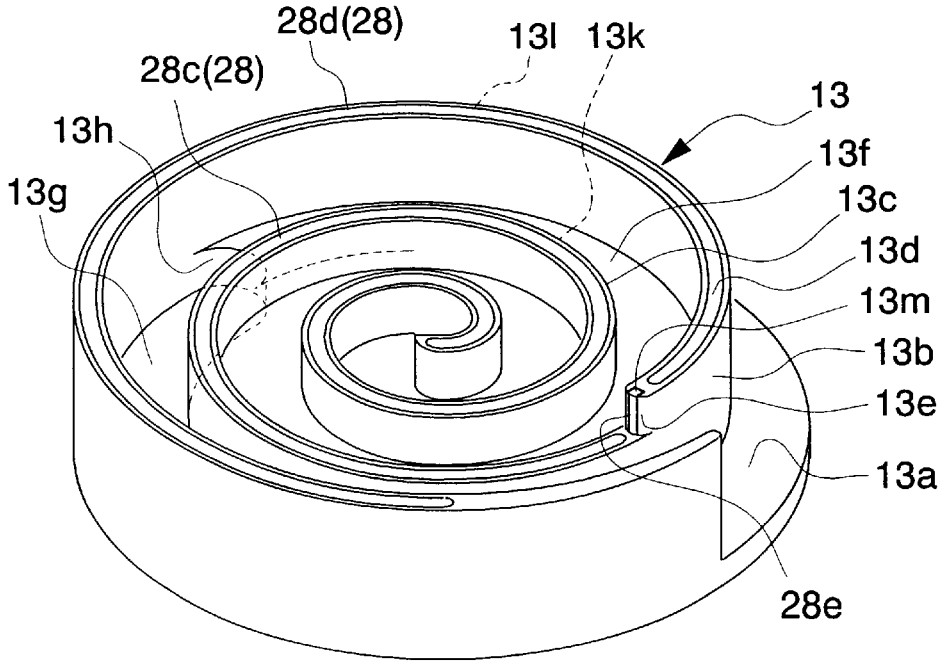
FIG. 2B is a perspective view of a swiveling scroll.

FIGS. 2A and 2B are perspective views of the fixed scroll 12 and the swiveling scroll 13 respectively.

The spiral top edge of the wall body 12*b* of the fixed scroll 12 is separated into two parts, and has a step between the low center side of the spiral and the high outer end side. Similarly, the spiral top edge of the wall body 13*b* of the swiveling scroll 13 is separated into two parts, and has a step between the low center side in the spiral direction and the high outer end side.

Furthermore, the end plate 12*a* of the fixed scroll 12 has a two-part step-like shape corresponding to the parts of the top edge of the wall body 13*b*, the height of one side face thereof being high at the center of the spiral and becoming low at the outer end. Similarly, the end plate 13*a* of the swiveling scroll 13 has a two-part step-like shape, the height of one side face thereof being high at the center of the spiral and becoming low at the outer end.

The top edge of the wall body 12*b* divides into two parts of a low top edge 12*c*, provided near the center, and a high top edge 12*d*, provided near the outer side; a join edge 12*e* is perpendicular to the rotating face and is provided between the adjacent top edges 12*c* and 12*d* to connect. Similarly, the top edge of the wall body 13*b* divides into two parts of a low top edge 13*c*, provided near the center, and a high top edge 13*d*, provided near the outer side; a join edge 13*e* is perpendicular to the rotating face and is provided between the adjacent top edges 13*c* and 13*d* to connect.

The bottom face of the end plate 12*a* divides into two parts of a shallow bottom face 12*f*, provided near the center, and a deep bottom face 12*g*, provided near the outer side; a join wall face 12*h* is perpendicular to the bottom faces and is provided between the adjacent bottom faces 12*f* and 12*g* to connect. Similarly, the bottom face of the end plate 13*a* divides into two parts of a shallow bottom face 13*f*, provided near the center, and a deep bottom face 13*g*, provided near the outer side; a join wall face 13*h* is perpendicular to the bottom faces and is provided between the adjacent bottom faces 13*f* and 13*g* to connect.

When the wall body 12*b* is seen from the direction of the swiveling scroll 13, the join edge 12*e* smoothly joins the inner and outer side faces of the wall body 12*b*, and forms a semicircle having a diameter equal to the thickness of the wall body 12*b*. Similarly, the join edge 13*e* smoothly joins the inner and outer side faces of the wall body 13*b*, and forms a semicircle having a diameter equal to the thickness of the wall body 13*b*.

When the end plate 12*a* is seen from the rotation axis direction, the shape of the join wall face 12*h* is a circular arc which matches the envelope curve drawn by the join edge 13*e* as the swiveling scroll orbits; similarly, the shape of the join wall face 13*h* is a circular are which matches the envelope curve drawn by the join edge 12*e*.

Figure 3:
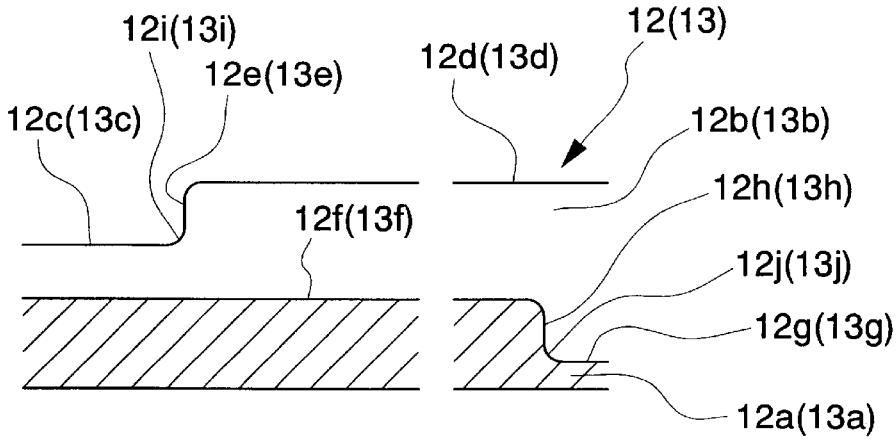
FIG. 3 is a side cross-sectional view of a rib provided between a top edge and a join edge, and a rib provided between a bottom face and a join wall face.

A rib 12*i* shown in FIG. 3 is provided in the section of the wall body 12*b* where the top edge 12*d* and the join edge 12*e* meet each other. To avoid concentration of stress, the rib 12*i* has a smooth concave face which connects the top edge 12*c* to the join edge 12*e*, and is united with the wall body 12*b*. A rib 13*i* is provided in the section of the wall body 13*b* where the top edge 13*c* and the join edge 13*e* meet each other, and, for similar reasons, has the same shape as the rib 12*i*.

A rib 12*j* is provided like a padding in the section of the end plate 12*a* where the bottom face 12*g* and the join wall face 12*h* meet each other. To avoid concentration of stress, the rib 12*j* has a smooth concave face which connects the bottom face 12*g* to the join wall face 12*h*, and is united with the wall body 12*b*. A rib 13*j* is provided in the section of the end plate 13*a* where the bottom face 13*g* and the join wall face 13*h* meet each other, and, for similar reasons, has the same shape as the rib 12*j*.

The section of the wall body 12*b* where the top edges 12*c* and 12*e* meet each other, and the section of the wall body 13*b* where the top edges 13*c* and 13*e* meet each other are chamfered at the time of assembly to prevent them from interfering with the ribs 13*j* and 12*j* respectively.

Furthermore, tip seals 27*c* and 27*d* are provided respectively on the top edges 12*c* and 12*d* of the wall body 12*b*, and tip seal (sealing member) 27*e* is provided on the join edge 12*e*. Similarly, tip seals 28*c* are 28*d* are provided respectively on the top edges 13*c* and 13*d* of the wall body 13*b*, and a tip seal (sealing member) 28*e* is provided on the join edge 13*e*.

The tip seals 27*c* and 27*d* have spiral shape, and are embedded in grooves 12*k* and 12*l*, provided along the spiral direction in the top edges 12*c* and 12*d*. When the compressor is operating, a high-pressure fluid is led into the grooves 12*k* and 12*l* and applies a back pressure to the tip seals 27*c* and 27*d*. The tip seals 27*c* and 27*d* are pressed against the bottom faces 13*f* and 13*g* by the back pressure and thereby functioning as seals. The tip seals 28*c* and 28*d* similarly have spiral shape, and are embedded in grooves 13*k* and 13*l*, provided along the spiral direction in the top edges 13*c* and 13*d*. When the compressor is operating, a high-pressure fluid is led into the grooves 13*k* and 13*l* and applies a back pressure to the tip seals 28*c* and 28*d*. The tip seals 28*c* and 28*d* are pressed against the bottom faces 12*f* and 12*g* by the back pressure and thereby functioning as seals.

Figure 4A:
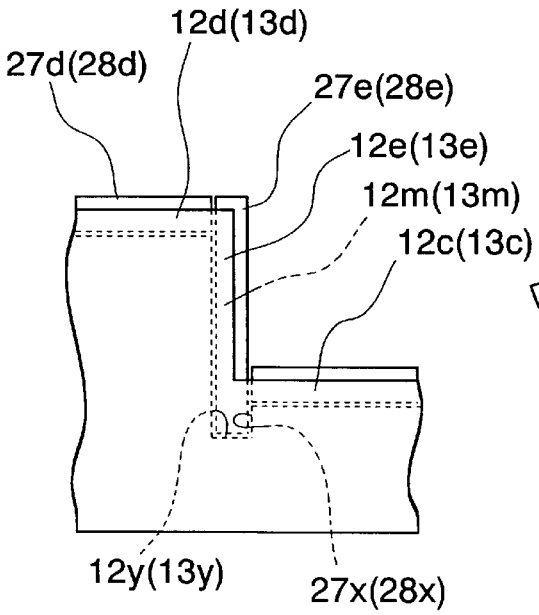
FIG. 4A is a plan view of a tip seal provided on the join edge as seen from the rotation axial direction.
Figure 4B:
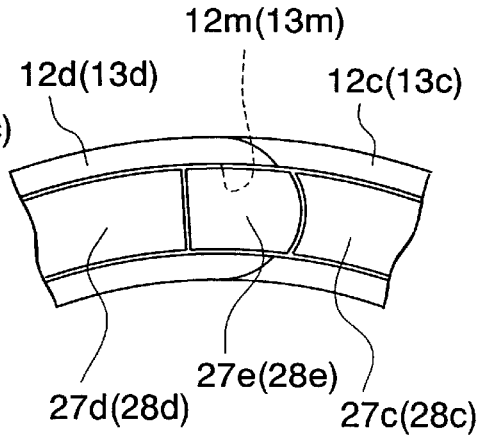
FIG. 4B is a plan view of a tip seal provided on the join edge as seen from the side.

As shown in FIG. 4A, the tip seal 27*e* has a rod-like shape, the groove 12*m* is provided in the join edge 12*e*, and the convex section 27*x*, which is longer than the join edge 12*e*, is provided in one end of the tip seal 27*e*. The groove 12*m* is deeper than the join edge 12*e* and has a concavity 12*y* into which the convex section 27*x* is engaged with movable space. The section of the tip seal 27*e* which slides against the join wall face for airtightness may have any shape as long as airtightness is maintained, and, in this example, the section has a semicircular are so as to achieve even greater airtightness. Furthermore, the convex section 27*x* of the tip seal 27*e* is engaged into the concavity 27*y*, which continues to the groove 12*m*, with movable space, thereby preventing the tip seal 27*e* from falling off even when the step section has become disconnected.

When the swiveling scroll 13 is attached to the fixed scroll 12, the lower top edge 13*d* directly contacts the shallow bottom face 12*f*, and the higher top edge 13*e* directly contacts the deep bottom face 12*g*. Simultaneously, the lower top edge 12*d* directly contacts the shallow bottom face 13*f*, and the higher top edge 12*e* directly contacts the deep bottom face 13*g*. Consequently, a compression chamber C is formed by partitioning the space in the compressor by the end plates 12*a* and 13*a*, and the wall bodies 12*b* and 13*b*, which face each other between the two scrolls (see FIGS. 5 to 8).

The compression chamber C moves from the outer end toward the center as the swiveling scroll 13 rotates. While the contact points of the wall bodies 12*b* and 13*b* are C nearer the outer end than the join edge 12*e*, the join edge 12*e* slides against the join wall face 13*h* so that there is no leakage of fluid between the compression chambers C (one of which is not airtight), which are adjacent to each other with the wall body 12 therebetween. While the contact points of the wall bodies 12*b* and 13*b* are not nearer the outer end than the join edge 12*e*, the join edge 12*e* does not slide against the join wall face 13*h* so that equal pressure is maintained in the compression chambers C (both of which are airtight), which are adjacent to each other with the wall body 12 therebetween.

Similarly, while the contact points of the wall bodies 12*b* and 13*b* are nearer the outer end than the join edge 13*e*, the join edge 13*e* slides against the join wall face 12*h* so that there is no leakage of fluid between the compression chambers C (one of which is not airtight), which are adjacent with the wall body 13 therebetween. While the contact points of the wall bodies 12*b* and 13*b* are not nearer the outer end than the join edge 13*e*, the join edge 13*e* does not slide against the join wall face 12*h* so that equal pressure is maintained in the compression chambers C (both of which are airtight), which are adjacent with the wall body 13 therebetween. Incidentally, the join edge 12*e* slides against the join wall face 13*h* at the same time as the join edge 13*e* slides against the join wall face 12*h* during a half-rotation of the swiveling scroll 13.

The process of compressing fluid during operation of the scroll compressor having the constitution described above will be explained with reference to FIGS. 5 to 8 in that order.

Figure 5:
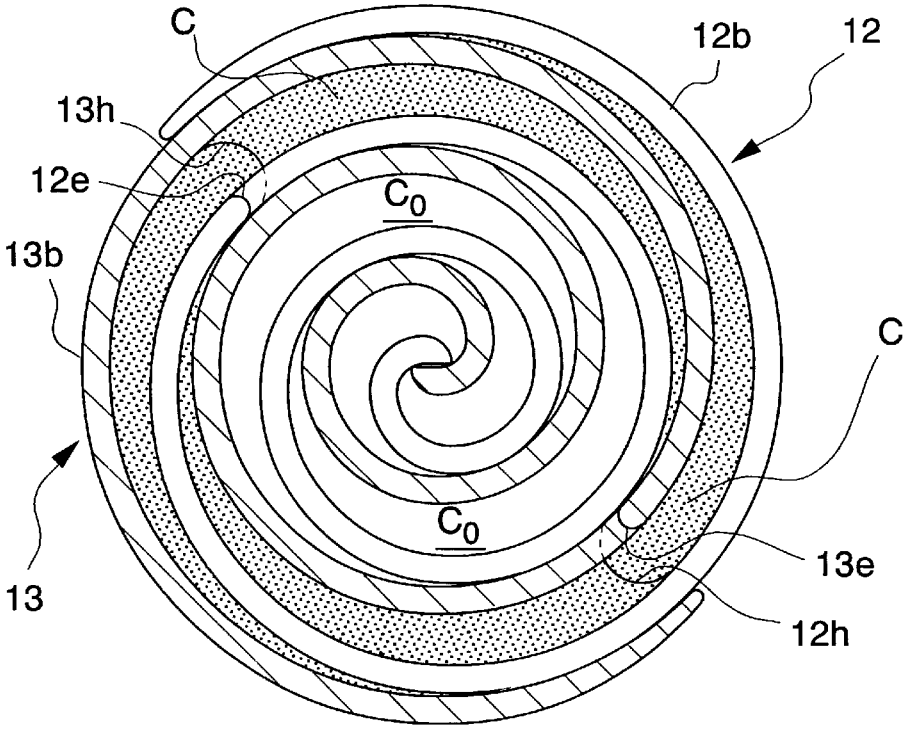
FIG. 5 is a diagram illustrating a process of compressing a fluid when driving the scroll compressor.

In the state shown in FIG. 5, the outer end of the wall body 12*b* directly contacts the outer face of the 13*b*, and the outer end of the wall body 13*b* directly contacts the outer face of the wall body 12*b*; the fluid is injected between the end plates 12*a* and 13*a*, and the wall bodies 12*b* and 13*b*, forming two large-capacity compression chambers C at exactly opposite positions on either side of the center of the scroll compressor mechanism. At this time, the join edge 12*e* slides against the join wall face 13*h*, and the join edge 13*e* slides against the join wall face 12*h*, but this sliding ends immediately afterwards.

Figure 6:
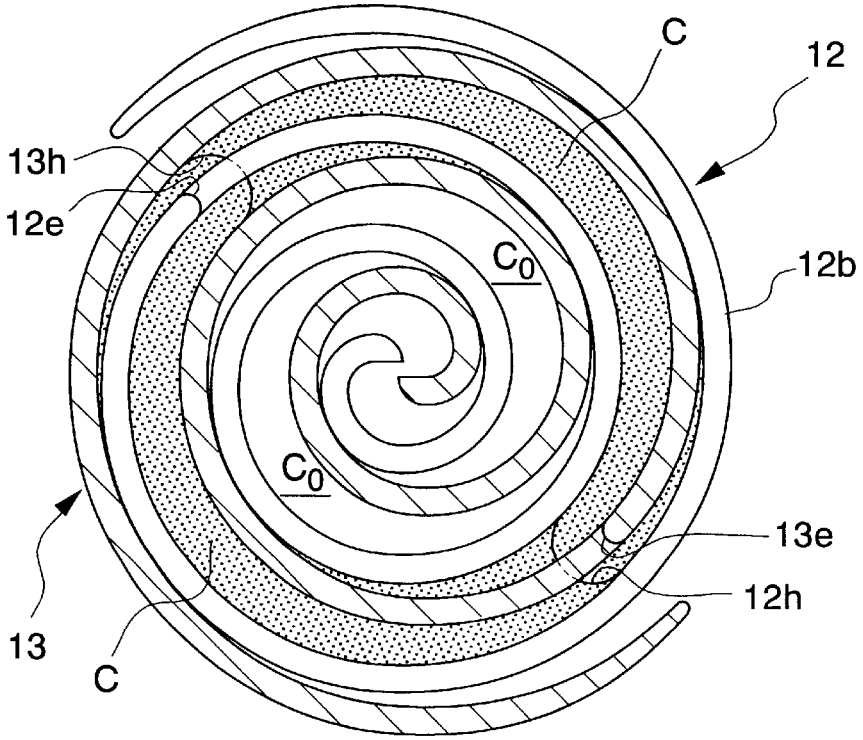
FIG. 6 is another diagram illustrating a process of compressing a fluid when driving the scroll compressor.

FIG. 6 shows the state when the swiveling scroll 13 has revolved by $\pi/2$ from the state shown in FIG. 5. In this process, the compression chamber C moves toward the center with its airtightness intact while compressing the fluid by the gradual reduction of its capacity; the compression chamber $C_0$ preceding the compression chamber C also moves toward the center with its airtightness intact while continuing to compress the fluid by the of gradual reduction of its capacity. The sliding contact between the join edge 12*e* and the join wall face 13*h*, and between the join edge 13*e* and the join wall face 12*h*, ends in this process, and the two compression chambers C, which are adjacent to each other with the wall body 13 therebetween, are joined together with equal pressure.

Figure 7:
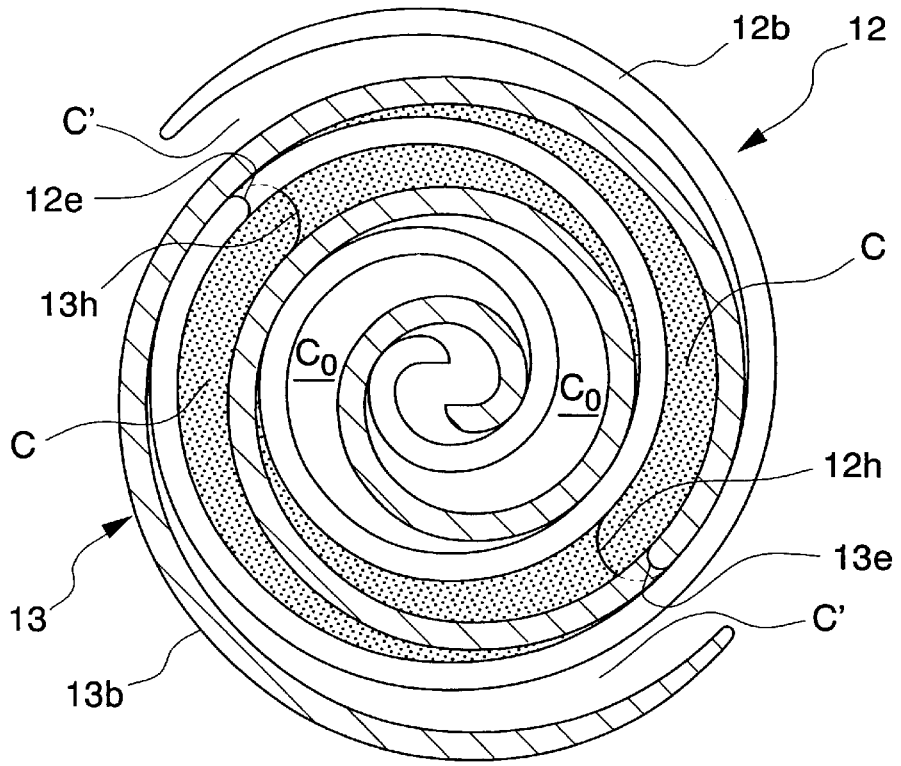
FIG. 7 is another diagram illustrating a process of compressing a fluid when driving the scroll compressor.

FIG. 7 shows the state when the swiveling scroll 13 has revolved by $\pi/2$ from the state shown in FIG. 6. In this process, the compression chamber C moves toward the center with its airtightness intact while compressing the fluid by the gradual reduction of its capacity; the compression chamber $C_0$ preceding the compression chamber C also moves toward the center with its airtightness intact while continuing to compress the fluid by the gradual reduction of its capacity. The sliding contact between the join edge 12*e* and the join wall face 13*h*, and between the join edge 13*e* and the join wall face 12*h*, ends in this process, and the two compression chambers C, which are adjacent to each other with the wall body 13 therebetween, continue to be joined together with equal pressure.

In the state shown in FIG. 7, a space C' is formed between the inside face of the wall body 12*b*, which is near the outer peripheral end, and the outside face of the wall body 13*b*, positioned on the inner side of the inside face of the wall body 12*b*; this space C' becomes a compression chamber later. Similarly, a space C' is formed between the inside face of the wall body 13*b*, which is near the outer peripheral end, and the outside face of the wall body 12*b*, positioned on the inner side of the inside face of the wall body 13*b*; the space C' also becomes a compression chamber later. A low-pressure fluid is fed into the space C' from the suction chamber 22. At this time, the join edge 12*e* starts to slide against the join wall face 13*h*, and the join edge 13*e* starts to slide against the join wall face 12*h*, maintaining the airtightness of the compression chamber C which precedes the space C'.

Figure 8:
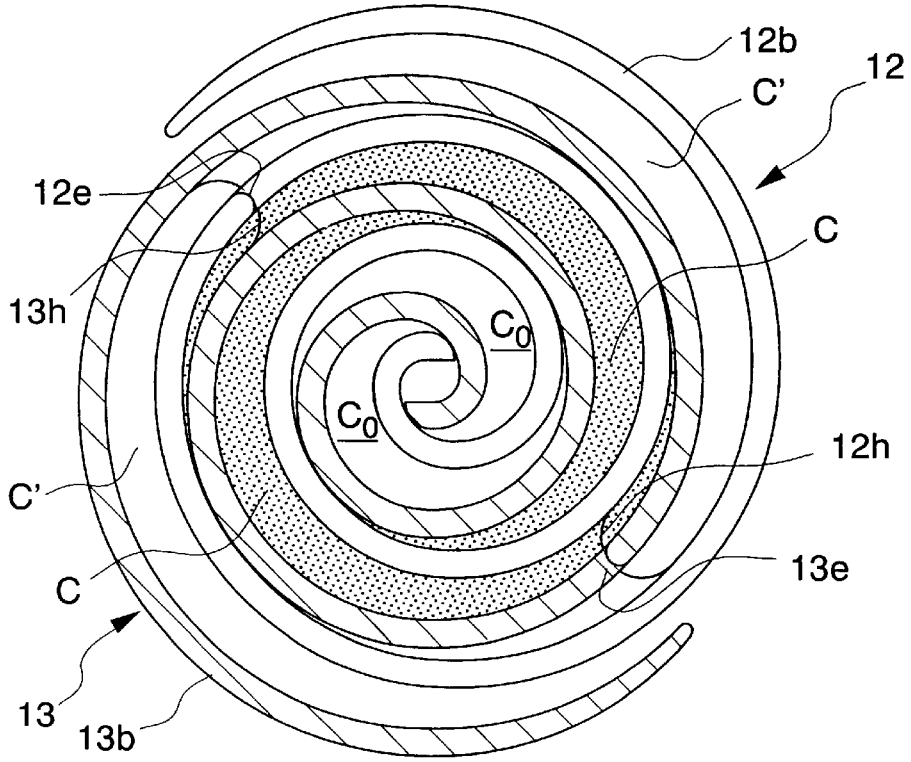
FIG. 8 is another diagram illustrating a process of compressing a fluid when driving the scroll compressor.

FIG. 8 shows the state when the swiveling scroll 13 has revolved by $\pi/2$ from the state shown in FIG. 7. In this process, the space C' increases in size while moving toward the center of the scroll compressor mechanism; the compression chamber C preceding the space C' also moves toward the center with its airtightness intact while compressing the fluid by the gradual reduction of its capacity. In this process, the sliding contact between the join edge 12*e* and the join wall face 13*h*, and between the join edge 13*e* and the join wall face 12*h*, continues; sealing the space C' and maintaining the airtightness of the compression chamber C.

FIG. 5 shows the state when the swiveling scroll 13 has revolved by $\pi/2$ from the state shown in FIG. 8. In this process, the space C' further increases in size while moving toward the center of the scroll compressor mechanism; the compression chamber C if preceding the space C' also moves toward the center with its airtightness intact while compressing the fluid by the gradual reduction of its capacity, and eventually reaches its minimum capacity. In this process, the sliding contact between the join edge 12*e* and the join wall face 13*h*, and between the join edge 13*e* and the join wall face 12*h*, continues; sealing the space C' and maintaining the airtightness of the compression chamber C.

The changes in the size of the compression chamber C when changing from its maximum capacity to its minimum capacity (the capacity when the discharge valve 26 is open) are here regarded as: compression chamber C of FIG. 5→ compression chamber C of FIG. 6→ compression chamber C of FIG. 7→ compression chamber C of FIG. 8. FIGS. 9A to 9D show the expanded shape of the compression chamber in each state of these changes.

Figures 9A, 9B, 9C, 9D:
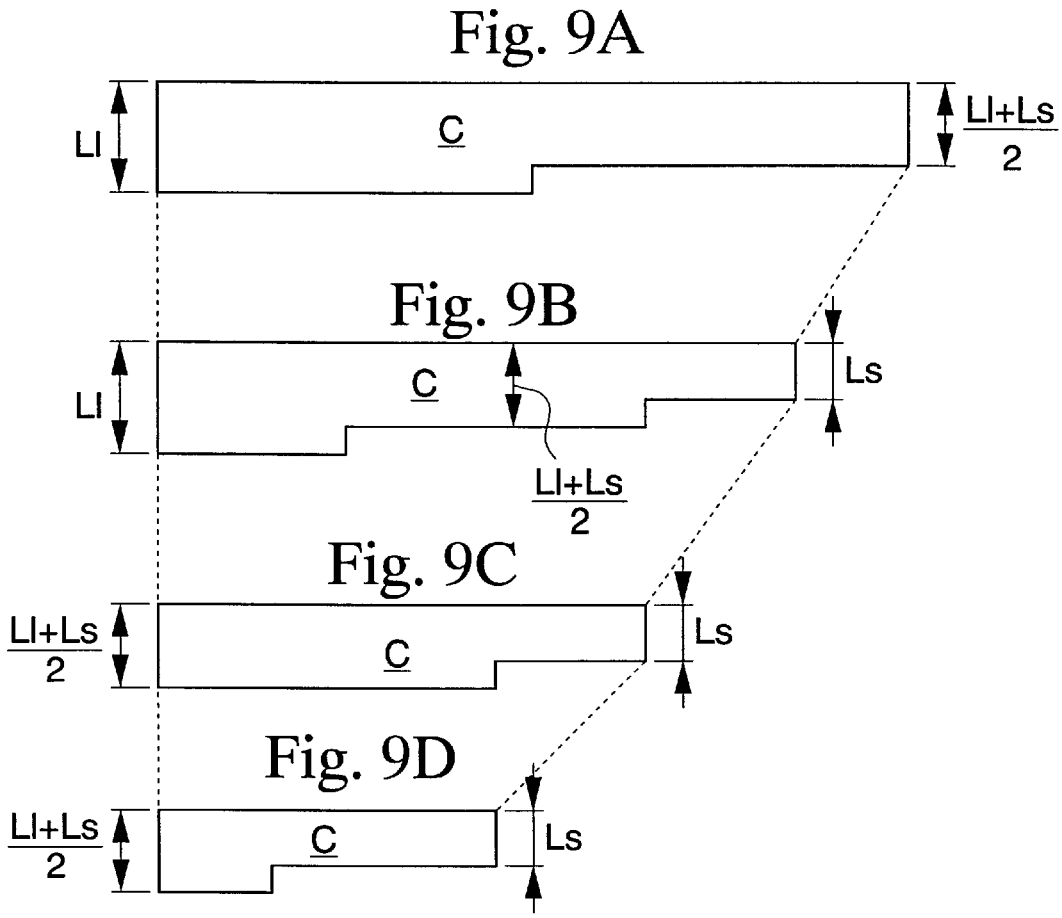
FIGS. 9A to 9D are status diagrams showing changes in the size of a compression chamber from maximum capacity to minimum capacity.

In the maximum capacity state shown in FIG. 9A, the compression chamber has an irregular rectangular shape in which the width in the rotating axis direction becomes narrower from the middle, and the width on the outer end side of the scroll compressor mechanism becomes wrap length Ll, which is substantially equal to the height of the wall body 12*b* from the bottom face 12*g* to the top edge 12*d* (or alternatively, the height of the wall body 13*b* from the bottom face 13*g* to the top edge 13*d*). When Ls (<Ll) represents the wrap length which is substantially equal to the height of the wall body 12*b* from the bottom face 12*f* to the top edge 12*c* (or alternatively, the height of the wall body 13*b* from the bottom face 13*f* to the top edge 13*c*), the wrap length in the center side is substantially equal to (Ll+Ls)/2.

In the state shown in FIG. 9B, the wrap length of the compression chamber has three stages: an outer side wrap length which is substantially equal to Ll, then, proceeding sequentially toward the center, a wrap length which is substantially equal to (Ll+Ls)/2, and a wrap length which is substantially equal to Ls. In this state, the length in the direction of rotation is shorter than that in the state of FIG. 9A. In addition, the Ll and (Ll+Ls)/2 sections are shorter, and a section having wrap length Ls appears.

In the state of FIG. 9C, the length in the direction of rotation becomes even shorter as the compression chamber moves toward the center. Furthermore, the Ll section disappears, leaving the two stages (Ll+Ls)/2 and Ls.

In the state shown in FIG. 9D, as in the state of FIG. 9C, the wrap length of the compression chamber has two stages of (Ll+Ls)/2 and Ls. In this state, the length in the direction of rotation is shorter than that in the state of FIG. 9C, and the section of(Ll+Ls)/2 is also shorter. Thereafter, the section of (Ll+Ls)/2 disappears, and eventually the discharge valve 26 opens and the fluid is discharged.

In the scroll compressor described above, change in the capacity of the compression chamber is not caused only by decrease in the cross-sectional area which is parallel to the rotating face, but is caused in multiple by decrease in the width in the rotating axis direction and decrease in the cross-sectional area, as shown in FIG. 7.

Therefore, when the wrap lengths of the wall bodies 12*b* and 13*b* near the outer side and center of the scroll compressor mechanism are changed so as to provide steps in the wall bodies 12*b* and 13*b*, increasing the maximum capacity and decreasing the minimum capacity of the compression chamber C, a higher compression ratio can be obtained than in the conventional scroll compressor where the wrap lengths of the wall bodies is constant.

Subsequently, a second embodiment of the scroll compressor according to the present invention will be explained with reference to FIGS. 10A to 10C. Components which are identical to those in the first embodiment are represented by the same reference codes and those explanations are omitted.

Figure 10A:
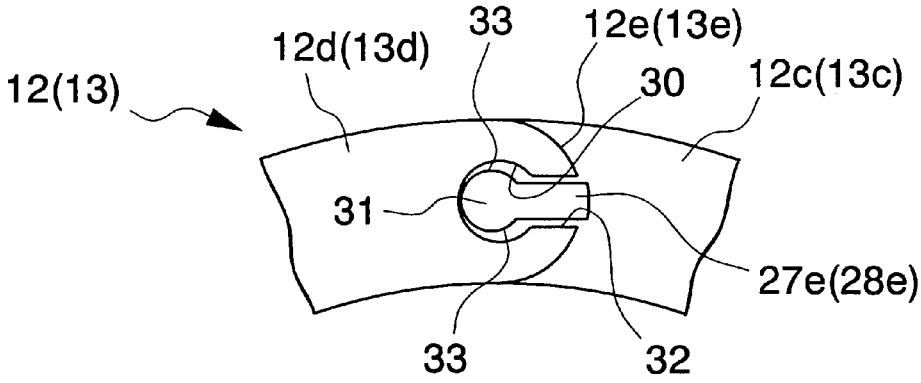
FIGS. 10A to 10C show a second embodiment of the scroll compressor according to the present invention, being plan views of a tip seal provided on a join edge as seen from the rotation axial direction.

In the second embodiment, as shown in FIG. 10A, the coupling section which connects the join edge 12*e* and the tip seal 27*e* comprises a groove 30, which is provided in connects the join edge 12*e*, and a filling section 31, which is provided on the tip seal 27*e* and engaged into the groove 30. A narrower section 32 is provided in the opening of the groove 30, and has a narrower width than the bottom section thereof. The filling section 31 has an enlarged section 33 which clips into the narrower section 32.

The filling section 31 and enlarged section 33 are formed in a single piece with the tip seal 27*e*; the groove 30 and the narrower section 32 are provided in a cutting process at the time of manufacturing the fixed scroll 12. In particular, after the groove 30 has been provided by using a drill to cut a section which is circular in cross-section, a section which passes through the surface of the tip seal 27*e* is cut while leaving the narrower section 32. Furthermore, the surface of the tip seal 27*e* is curved so as to form part of the sliding face of the tip seal 27*e*. A similar joint section is provided between the join edge 13*e* and the tip seal 28*e*.

In the scroll compressor described above, the enlarged section 33, provided in the filling section 31, engages into the narrower section 32, stopping the filling section 31 from becoming removed from the groove 30. The enlarged section 33 prevents the tip seal 27*e*, which is formed in a single piece with the filling section 31, from becoming removed from the join edge 12*e*, ensuring that the compressor operates smoothly.

In the embodiment, the surfaces of the tip seals 27*e* and 28*e* are curved and connect to the sliding faces of the join edges 12*e* and 13*e*, but the sliding faces of the join edges 27*e* and 28*e* are not limited to a curved shape and may conceivably be multi-sided shapes comprised of straight lines. In this case, the surfaces of the tip seals 27*e* and 28*e* are also straight lines.

Figure 10B:
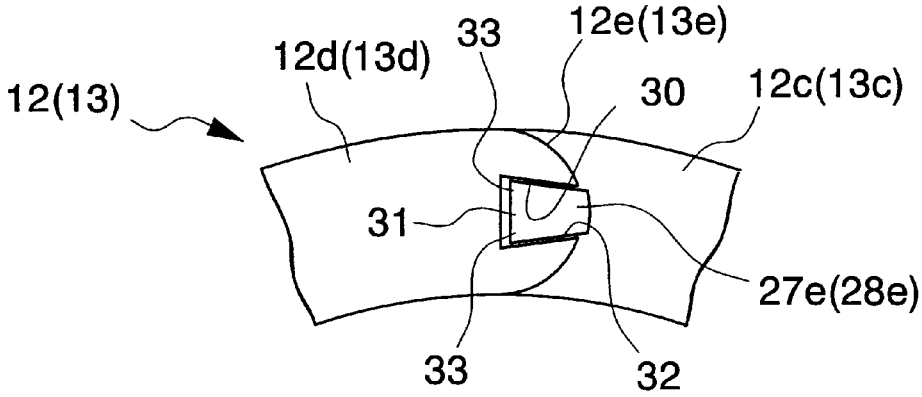

As shown in FIG. 10B, similar effects are obtained when the groove 30 and the tip seal 27*e* have the cross-sectional shape of a trapezoid having a pair of sides having equal length. The filling section and enlarged sections are provided on the tip seal 27 itself.

Figure 10C:
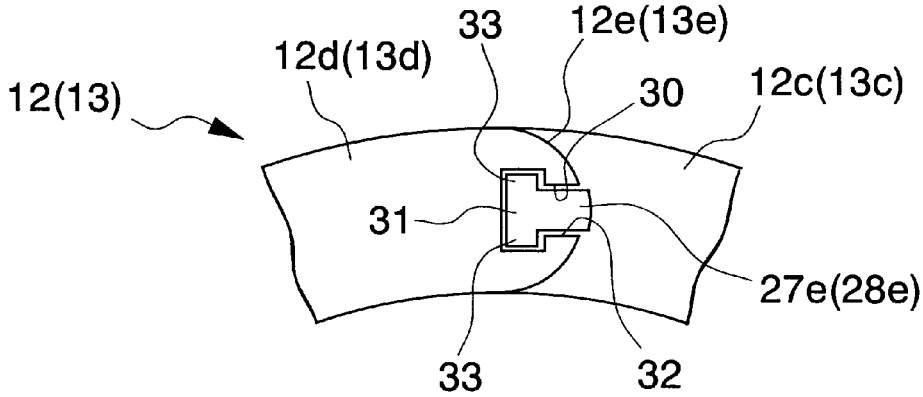

As shown in FIG. 10C, The groove 30 is T-shaped in cross-section, the narrower section 32 is provided in the front side of the groove 30 and is narrower than the bottom side of the groove. Similarly, the tip seal 27*e* is correspondingly provided narrow at the front and has enlarged section 33 at its base. Similar effects are obtained when the narrower section 32 and the enlarged section 33 are engaged each other.

Figure 11:
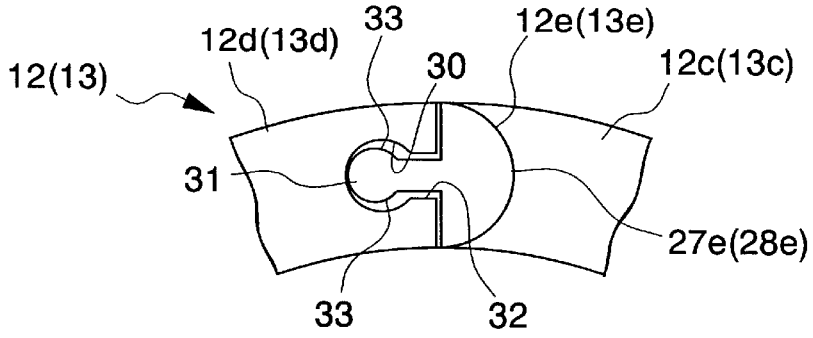
FIG. 11 is a diagram showing a second embodiment of the scroll compressor according to the present invention, being a plan view of a tip seal provided on a join edge as seen from the rotation axial direction.

Furthermore, in FIG. 11, the tip seal 27*e* forms the entire circular-are sliding face of the join edge 12*e*. The tip seal 28*e* is formed in a similar shape. In this case, since the tip seal 27*e* forms the entire sliding face of the join edge 12*e* which slides against the join wall face 13*h*, the tip seal 27*e* remains highly airtight while the join edge 12*e* and the join wall face 13*h* are sliding against each other. Therefore, the capability of the scroll compressor is further increased.

Subsequently, a third embodiment of the scroll compressor according to the present invention will be explained based on FIGS. 12A and 12B. Components which have already been described in the first and second embodiments are represented by the same reference codes and those explanations are omitted.

In this embodiment, the tip seal 27*e* connects to other tip seals 27*c* and 27*d*, which are provided along the top edges 12*c* and 12*d*, maintaining airtightness with the bottom faces 13*f* and 13*g*. The tip seal 28*e* has a similar shape.

Conventional constitutions have been disclosed (see Japanese Unexamined Patent Application, First Publication, No. 8-28461) in which the tip seal 27*d* and the tip seal 27*e* are formed in a single piece, or alternatively, the tip seals 27*d*, 27*e*, and 27*c* are formed in a single piece. However, in these constitutions, when the step section has separated, the tip seals become a cantilever or are removed in the direction of the tip seal groove, reducing reliability.

Figure 12A:
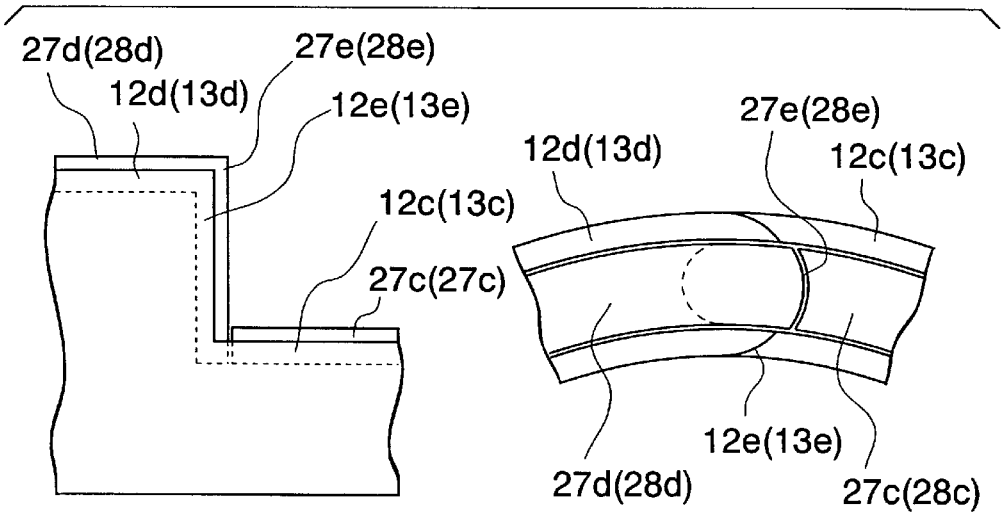
FIG. 12A is a diagram showing a third embodiment of the scroll compressor according to the present invention, being a plan view of a tip seal provided on a join edge as seen from the rotation axial direction.
Figure 12B:
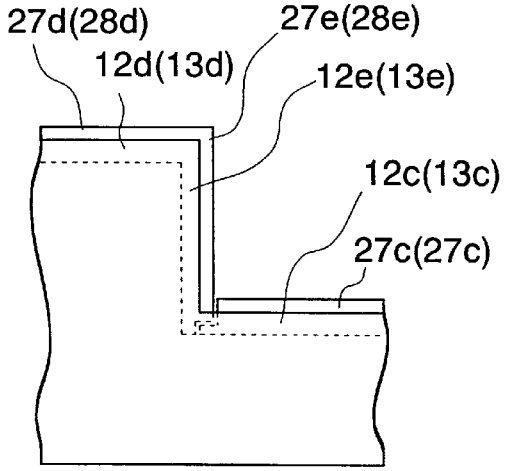
FIG. 12B is a diagram showing the third embodiment of the scroll compressor according to the present invention, being a plan view of a tip seal provided on a join edge as seen from the side.

In the scroll compressor shown in FIG. 12A, the tip seal 27*e* connects to the other tip seal 27*d*. Since the end face of the separated tip seal 27*c* presses against the tip of the tip seal 27*e*, during the period when the join edge 12*e* is not sliding against the join wall face 12*h*, the end face of the tip seal 27*c* support the cantilever of the tip seal 27*e*, and prevents the tip seal 27*e* from becoming removed from the 12*e*. Therefore, the compressor can operate smoothly and with increased reliability. In FIG. 12B, the end sections of the tip seals 27*e* and 27*c* are combined in a hook-shape, preventing not only the tip seal 27*e* but also the tip seal 27*c* from sticking up when separated, further increasing reliability.

Figure 13A:
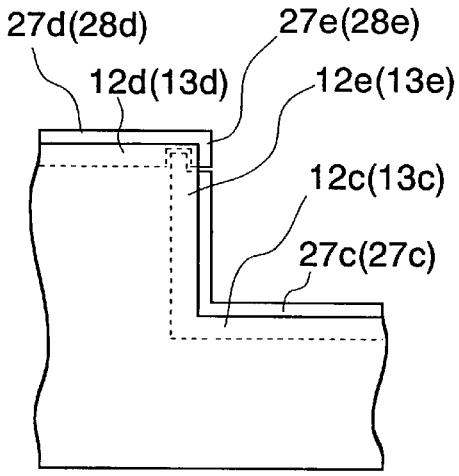
FIG. 13A is a side view of the embodiment of a tip seal which is additionally applied in the present embodiment.
Figure 13B:
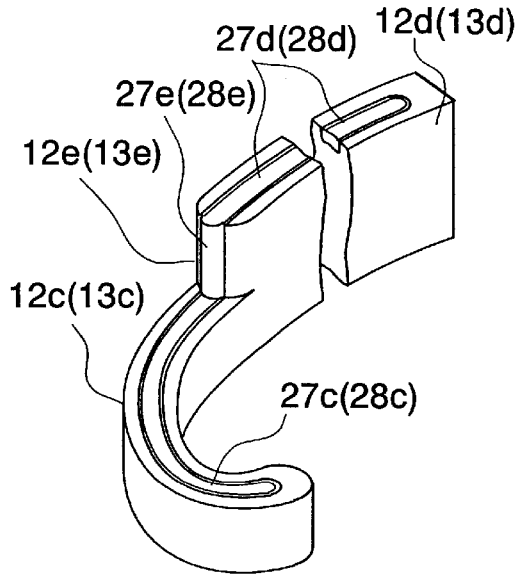
FIG. 13B is a perspective view of the embodiment of a tip seal which is additionally applied in the present embodiment.

In this embodiment, the tip seals 27*d* and 27*e* are provided in a single piece, but the constitution shown in FIG. 13A, in which the tip seals 27*c* and 27*e* are provided in a single piece and only the tip seal 27*d* is separated, or the constitution shown in FIG. 13B, in which all the tip seals 27*d*, 27*e*, and 27*c* are provided in a single piece, are acceptable. When all the tip seals are provided in a single piece, the gaps between the end section of the tip seals 27*c* and 27*d* and the tip seal groove are reduced to prevent the tip seals from falling off when separated, thereby increasing reliability.

Figure 14:
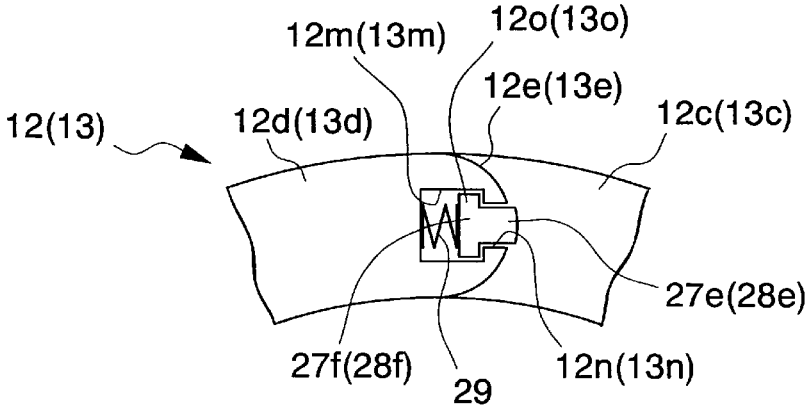
FIG. 14 is a diagram showing a fourth embodiment of the scroll compressor according to the present invention, being a plan view of a tip seal provided on a join edge as seen from the rotation axial direction.

Subsequently, a fourth embodiment of the scroll compressor according to the present invention will be explained with reference to FIG. 14. Components which are identical to those in the previous embodiments are represented by the same reference codes and those explanations are omitted.

This embodiment comprises an elastic material, provided between the join edge 12*e* and the tip seal 27*e*, applying a force in the direction of separation from the join edge 12*e*.

In the above scroll compressor, airtightness of the sliding section is increased when this section slides against the step, further increasing the capability of the scroll compressor.

Figure 15:
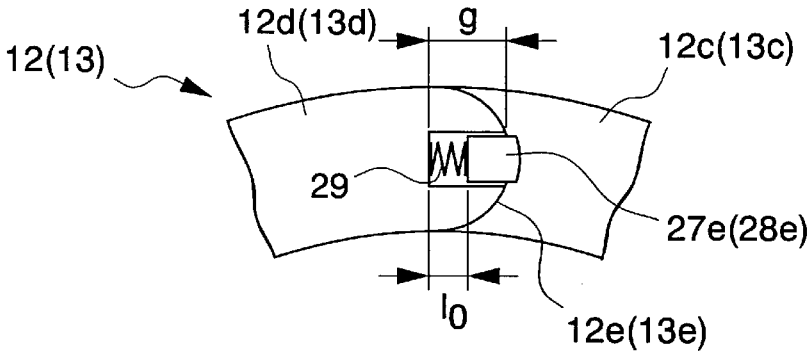
FIG. 15 is a diagram showing a fifth embodiment of the scroll compressor according to the present invention, being a plan view of a tip seal provided on a join edge as seen from the rotation axial direction.

Subsequently, a fifth embodiment of the scroll compressor according to the present invention will be explained with reference to FIG. 15. Components which are identical to those in the previous embodiments are represented by the same reference codes and those explanations are omitted.

This embodiment comprises the elastic material 29, provided between the join edge 12*e* and the tip seal 27*e*; the elastic material 29 is secured to the join edge 12*e* and to the tip seal 27*e*. The groove depth (g) of the join edge 12*e* is longer than the natural length (10) of the elastic material 29.

In the above scroll compressor, airtightness of the sliding section is increased when sliding against the step, further increasing the capability of the scroll compressor. Further, the elastic material secures the tip seal 27*e* and the join edge 12*e*, and the tip seal 27*e* is prevented from removal by controlling the dimensions so that g>10, thereby achieving high reliability.

Figure 16:
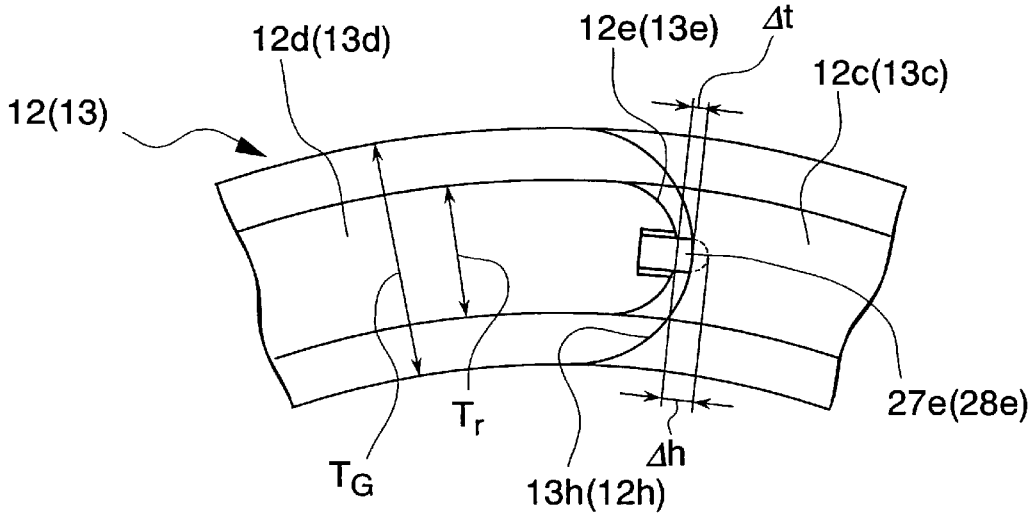
FIG. 16 is a diagram showing a sixth embodiment of the scroll compressor according to the present invention, being a plan view of a tip seal provided on a join edge as seen from the rotation axial direction.

Subsequently, a sixth embodiment of the scroll compressor according to the present invention will be explained with reference to FIG. 16. Components which are identical to those in the previous embodiments are represented by the same reference codes and those explanations are omitted.

In the sixth embodiment, in the state where the tip seal 27*e*, which is provided on the join edge 12*e*, slides against the join face, the initial dimensions are such that the tip seal 27*e* slides against the join wall face when the scroll member is incorporated. The relationship between the initially set step gap Δt, the amount of step seal protrusion Ah, the scroll groove width $T_G$, and the scroll wrap width Tr. Furthermore, Δt>Δh. Consequently, the airtightness of the sliding section when sliding against the step can be increased by using a simple constitution, further increasing the capability of the scroll compressor and reducing cost.

Subsequently, a seventh embodiment of the scroll compressor according to the present invention will be explained.

In this embodiment, the tip seal 27*e* for sealing the step comprises a polymer material. Consequently, the airtightness of the sliding section when sliding against the step can be increased by using a simple constitution, further increasing the capability of the scroll compressor and reducing cost.

Figure 17:
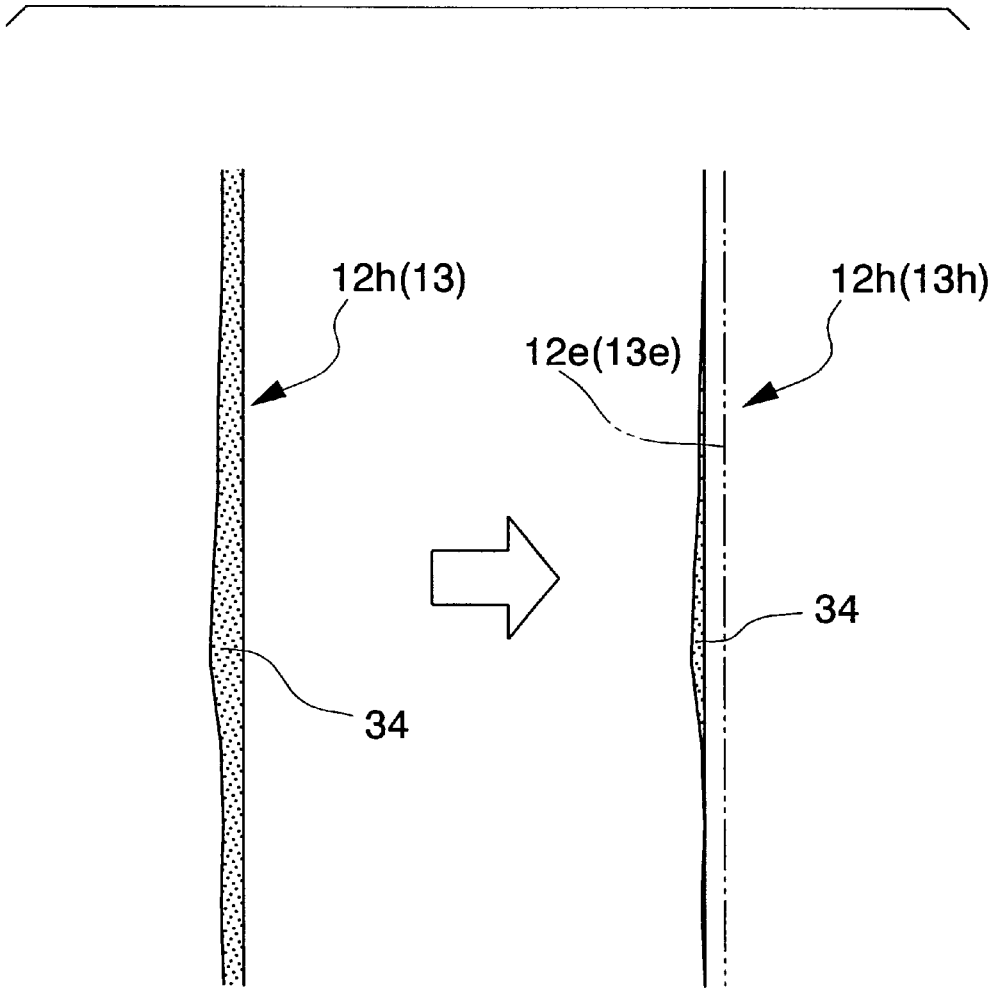
FIG. 17 is a diagram showing an eighth embodiment of the scroll compressor according to the present invention, and illustrates the state of a join wall face prior to assembling the scroll and the state of the join wall face after the scroll has driven after assembling the join wall face.

Subsequently, an eighth embodiment of the scroll compressor according to the present invention will be explained with reference to FIG. 17. Components which are identical to those in the previous embodiments are represented by the same reference codes and those explanations are omitted.

In this embodiment, a layer of soft covering material 34 is provided over the each of the join wall faces 12*h* and 13*h*. "NYP3"(product name; manufactured by NICHIAS CORPORATION) is used as the soft covering material 34, which is worn away from the sliding motion of the join edges 12*e* and 13*e*.

In this scroll compressor, the covering material 34 is worn away as the compressor continues operating, but some of the covering material 34 remains in the gaps between the join wall faces 12*h* and 13*h* and the join edges 12*e* and 13*e*, allowing to join wall face to become accustomed to the rotation of the join edge 12*e* and increasing airtightness between the join edge and the join wall face 13*h*, thereby further increasing the capability of the compressor.

Figure 18A:
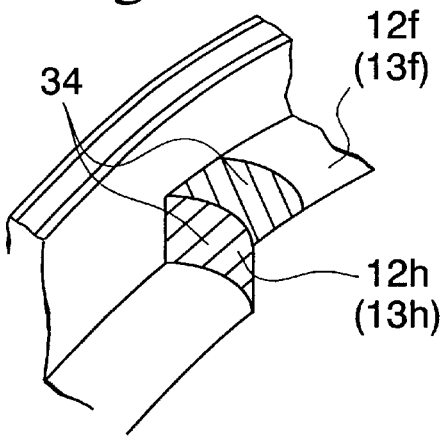
FIGS. 18A to 18E are perspective views of formative states (wall face side) of a covering material which is additionally applied in the present embodiment.
Figure 18B:
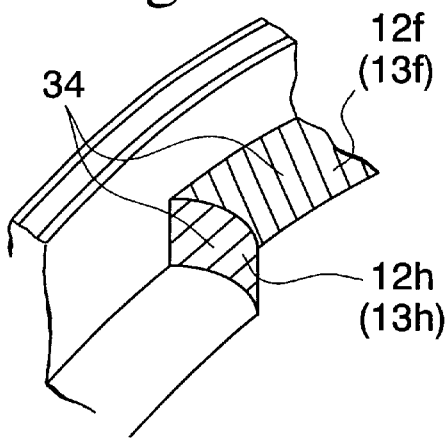
Figure 18C:
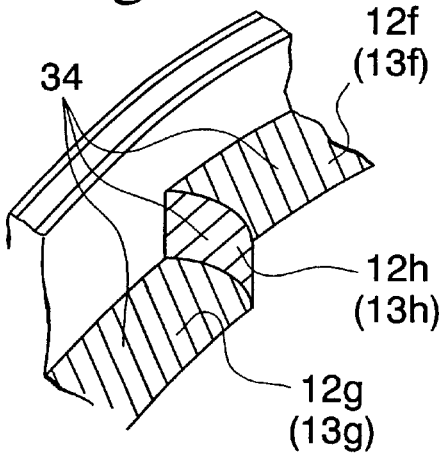
Figure 18D:
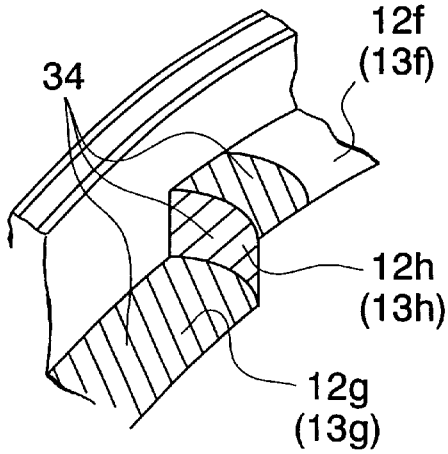
Figure 18E:
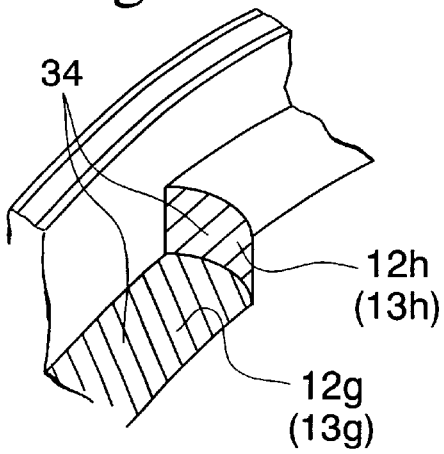

It is acceptable to provide the covering material over the join wall face 12*h* (13*h*) and the section of the shallow bottom face 12*f* (13*f*) where there is no tip seal (see FIG. 18A), over the join wall face 12*h* (13*h*) and the shallow bottom face 12*f* (13*f*) (see FIG. 18B), over the join wall face 12*h* (13*h*), the shallow bottom face 12*f* (13*f*), and the deep bottom face 12*g* (13*g*) (see FIG. 18C), over the join wall face 12*h* (13*h*) and the deep bottom face 12*g* (13*g*) and the section of the shallow bottom face 12*f* (13*f*) where there is no tips seal (see FIG. 18D), or over the join wall face 12*h* (13*h*) and the deep bottom face 12*g* (13*g*) (see FIG. 18E). By using the covering material in such arrangements, the above effects can be further increased.

Figure 19A:
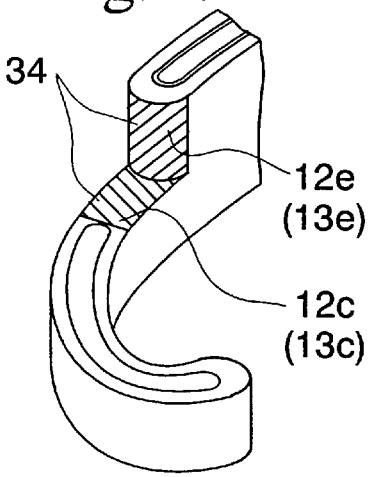
FIGS. 19A to 19E are perspective views of formative states (wall body side) of a covering material which is additionally applied in the present embodiment.
Figure 19B:
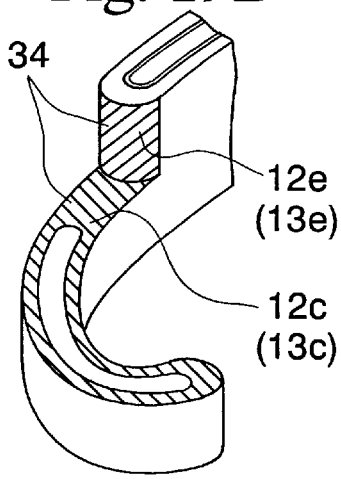
Figure 19C:
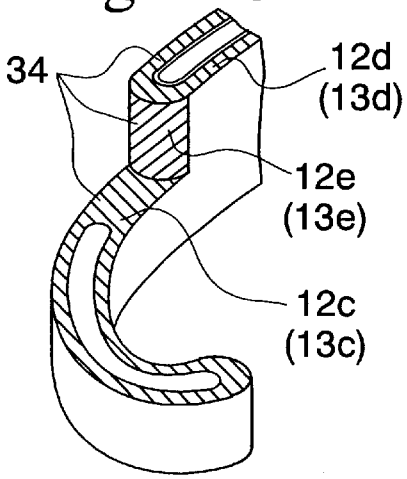
Figure 19D:
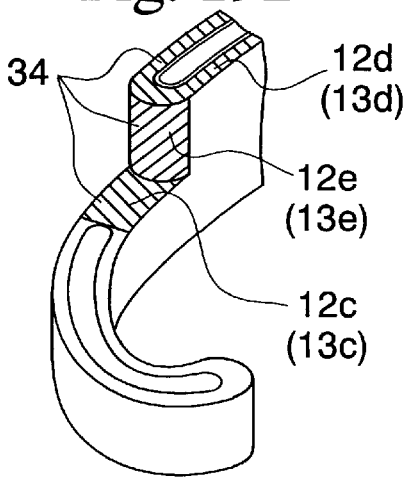
Figure 19E:
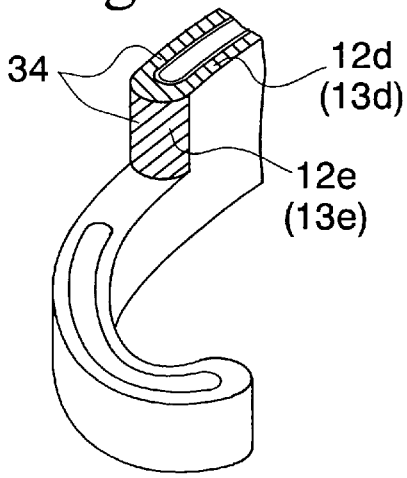

Similar effects are obtained when the covering material 34 is provided over the join edges 12*e* and 13*e*. For example, the covering material 34 may be provided over the join edge 12*e* (13*e*) and the portion of the lower top edge 12*c* (13*c*) where no tip seal is provided (see FIG. 19A), over the join edge 12*e* (13*e*) and the lower top edge 12*c* (13*c*) (see FIG. 19B), over the join edge 12*e* (13*e*), the upper top edge 12*d* (13*d*), and the lower top edge 12*c* (13*c*) (see FIG. 19C), over the join edge 12*e* (13*e*), the upper top edge 12*d* (13*d*), and the portion of the lower top edge 12*c* (13*c*) where no tip seal is provided (see FIG. 19D), or over the join edge 12*e* (13*e*) and the upper top edge 12*d* (13*d*) (see FIG. 19E). By using the covering material in such arrangements, the above effects can be further increased.

Molten or plated tin and copper, or iron phosphate, "AC COAT" (product name: manufactured by ASAHI CHIYODA KOGYO CO., LTD.) of molybdenum disulfide, and the like, may be used instead of "NYP3".

Subsequently, a ninth embodiment of the scroll compressor according to the present invention will be explained with reference to FIGS. 20 and 21. Components which are identical to those in the previous embodiments are represented by the same reference codes and those explanations are omitted.

Figure 20:
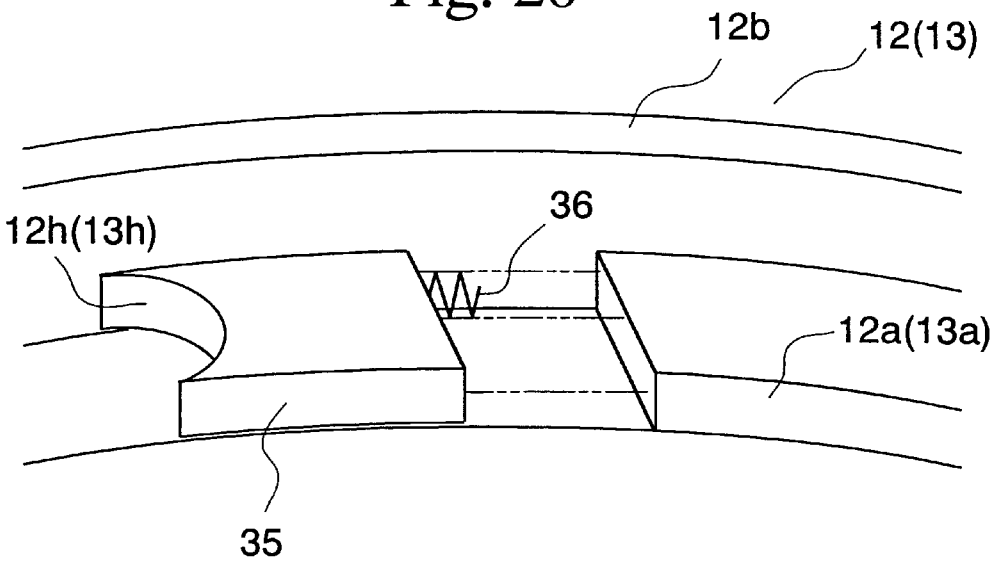
FIG. 20 is a diagram showing a ninth embodiment of the scroll compressor according to the present invention, being a perspective view of a block, which has been separated from an end plate main body, and the join structure of the block.

As shown in FIG. 20, in this embodiment, the part of the end plate 12*a* which has the join wall face 12*h* is separated from the main body, so as to become a block 35 forming a step. The block 35 can move between the adjacent inner and outer wall bodies 12*b* and 12*b* in the spiral direction, and is pressed outward from the spiral direction by a metallic compressed spring (compressing unit) 36, provided between the block 35 and the main body of the end plate 12*a*. A corrosive resistant material is used as the compressed spring 36.

Figure 21:
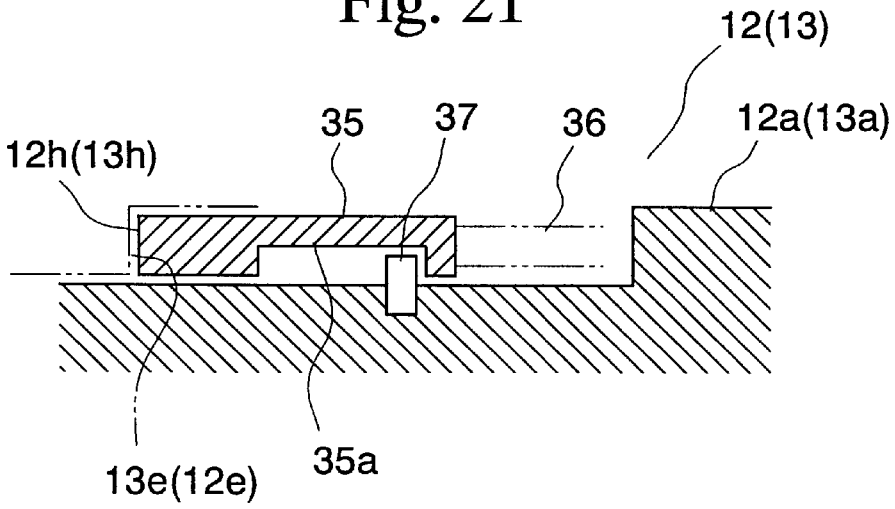
FIG. 21 is a cross-sectional view showing the relationship between the end plate main body, the block, and an axial body.

Furthermore, as shown in FIG. 21, a guide groove 35*a* is provided in the block 35 and runs parallel to the direction of movement of the sliding face with the main body of the end plate 12*a;* an axial body 37 fits into the groove 35*a,* and is secured to the main body of the end plate 12*a*. The axial body 37 fits into the groove 35*a* and guides the block 35 along the direction of the groove, i.e. along the spiral direction, allowing the block 35 to move within a distance corresponding to the length of the groove 35*a*. This distance is set to approximately twice the revolution radius, so that the join wall face 12*h* touches the join edge 12*e* even when the join edge 13*e* is at its maximum distance of separation from the join wall face 12*h*. The same constitution is applied for the end plate 13*a*.

In the scroll compressor described above, the compressed spring 36 presses the block 35 outward from the spiral direction, pushing the join wall face 12*h* against the join edge 13*e* and thereby increasing the airtightness. Moreover, when the movable range of the block 35 is set appropriately as described above, the join wall face 12*h* can be pushed against the join edge 13*e* even when not sliding. Consequently, airtightness between the join wall face 12*h* and the join edge 13*e* is increased, and the sliding motion of the two is regular, increasing the reliability of the scroll compressor.

Furthermore, the relationship between the guide groove 35*a* and the axial body 37 determines the movable range of the block 35, enabling the block 35 to be led in its moveable direction without obstruction, thereby ensuring that the compressor operates smoothly.

In this embodiment, the metallic compressed spring 36 is used as the pressing unit for the block 35, but another elastic material which has sufficient corrosive resistance and durability may be used. Furthermore, when an elastic material is not used and a space connecting to the compression chamber is provided, thereby keeping the block 35 freely movable, back pressure behind the block 35 acts as a pressing force, obtaining similar effects as those mentioned above.

In this embodiment, the guide groove 35*a* is provided in the block 35 and the axial body 37 is provided in the end plate 12*a* main body, but the axial body 37 may be provided in the block 35 and the guide groove 35*a* in the end plate 12*a* main body.

In each of the embodiments described above, the join edges 12*e* and 13*e* are perpendicular to the revolution face of the swiveling scroll 13, as are the join wall faces 12*h* and 13*h*. However, the join edges 12*e* and 13*e* and the join wall faces 12*h* and 13*h* need not be perpendicular to the revolution face as long as a corresponding relationship is maintained between them, e.g. they may be provided at a gradient to the revolution face.

In each of the embodiments described above, the fixed scroll 12 and the swiveling scroll 13 each have one step, but the scroll compressor according to the present invention is equally applicable when there are multiple steps.

Subsequently, a tenth embodiment of the scroll compressor according to the present invention will be explained with reference to FIGS. 22 to 23A–23D. Components which are identical to those in the first to ninth embodiments are represented by the same reference codes and those explanations are omitted.

Figure 22:
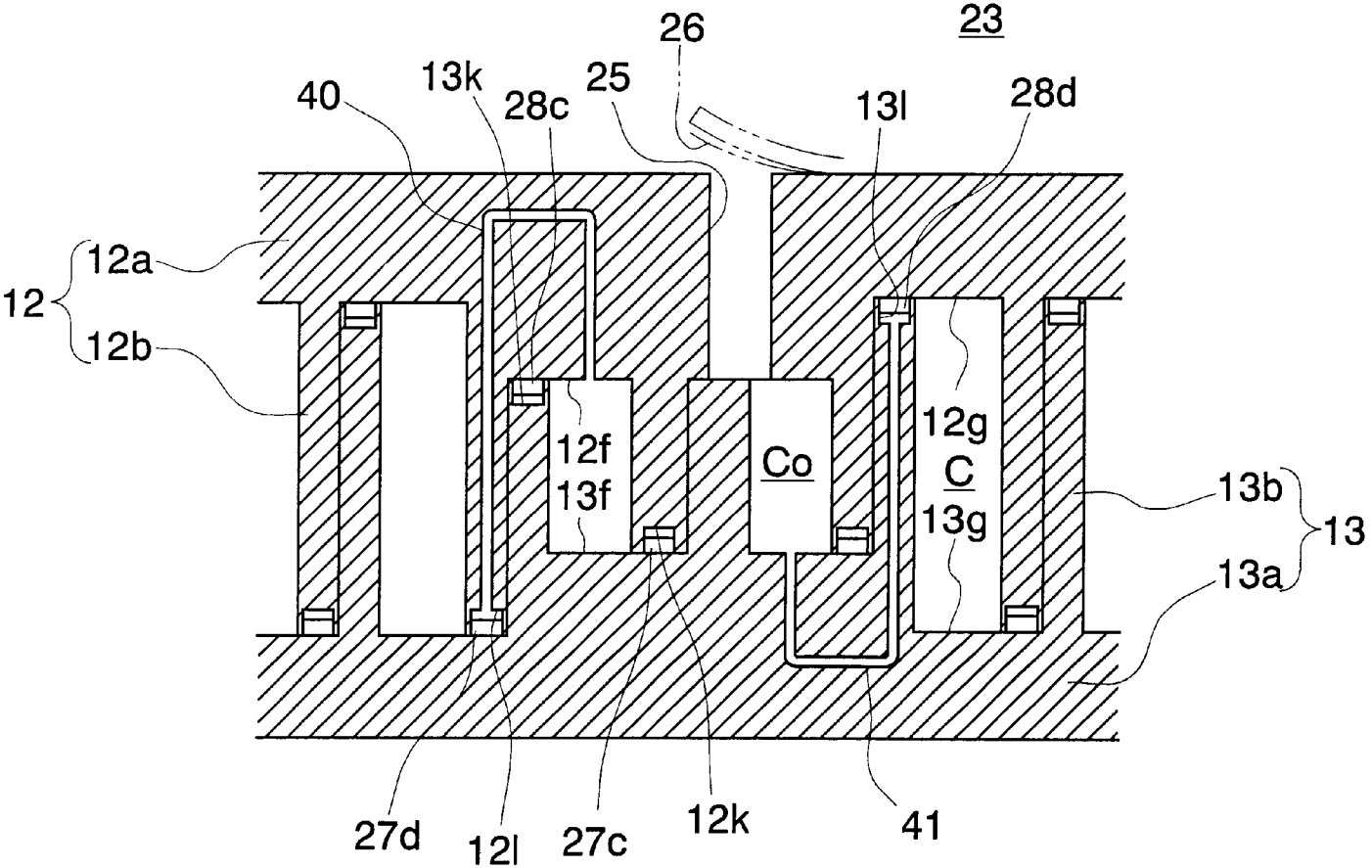
FIG. 22 is a diagram showing a tenth embodiment of the scroll compressor according to the present invention, being a cross-sectional view of a scroll compressor mechanism in which a fixed scroll and a swiveling scroll have been combined.

FIG. 22 is a cross-sectional view of a scroll compressor mechanism in which a fixed scroll and a swiveling scroll have been combined. The tip seal 27*e* has a rod-like shape and fits into a groove 12*m*, which is provided along the join edge 12*e*, while being prevented from coming out of the groove. As explained later, when the compressor is operating, an unillustrated pressing unit pushes the tip seal 27*e* against the join wall face 13*h*, enabling it to function as a seal. Similarly, the tip seal 28*e* has a rod-like shape and fits into a groove 13*m*, which is provided along the join edge 13*e*, while being prevented from coming out of the groove. When the compressor is operating, a pressing unit which is not illustrated pushes the tip seal 28*e* against the join wall face 12*h*, enabling it to function as a seal.

A join path (inlet path) 40 is provided in the fixed scroll 12, and joins a groove 121 to a high-pressure compression chamber C (C0). The join path 40 is made by tunneling between the end plate 12*a* and the wall body 12*b*, leading high pressure into the gap between the groove 121 and the tip seal 27*d*, which fits into the groove 121.

A join path (inlet path) 41 is provided in the swiveling scroll 13, and joins a groove 131 to the high-pressure compression chamber C (C0). The join path 41 is made by boring through the end plate 13*a* and the wall body 13*b*, leading high pressure into the gap between the groove 131 and the tip seal 28*d*, which fits into the groove 131.

FIGS. 5 to 8 illustrate a process of compressing fluid during operation of the scroll compressor having the constitution described above. The changes in the size of the compression chamber C when changing from its maximum capacity to its minimum capacity (the capacity when the discharge valve 26 is open) are here regarded as: compression chamber C of FIG. 5→ compression chamber C of FIG. 6→ compression chamber C of FIG. 7→ compression chamber C of FIG. 8. FIGS. 23A to 23D show the expanded shape of the compression chamber in each of these states.

Figures 23A, 23B, 23C, 23D:
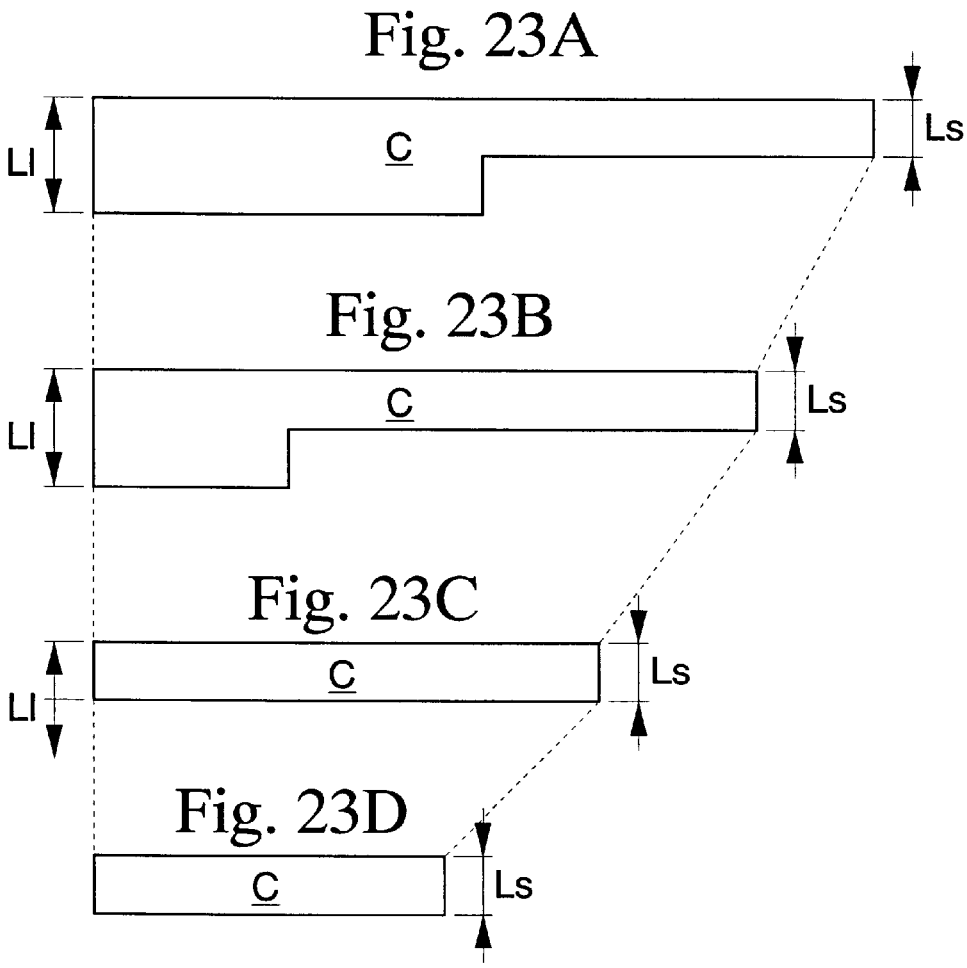
FIGS. 23A to 23D are diagrams illustrating changes in the size of a compression chamber from its maximum capacity to its minimum capacity.

In the maximum capacity state shown in FIG. 23A, the compression chamber has an irregular rectangular shape in which the width in the rotating axis direction becomes narrower from the middle, and the width on the outer end side of the scroll compressor mechanism becomes wrap length Ll, which is substantially equal to the height of the wall body 12*b* from the bottom face 12*g* to the top edge 12*d* (or alternatively, the height of the wall body 13*b* from the bottom face 13*g* to the top edge 13*d*). In the center side, the wrap length Ls (<Ll) is substantially equal to the height of the wall body 12*b* from the bottom face 12*f* to the top edge 12*c* (or alternatively, the height of the wall body 13*b* from the bottom face 13*f* to the top edge 13*c*).

In the state shown in FIG. 23B, as in the state of FIG. 23A, the compression chamber has an irregular rectangular shape in which the width in the rotating direction becomes narrower from the middle, but the compression chamber is longer in the rotating axis direction than in the state of FIG. 23A; the wrap length Ll section is shorter, and the length of the wrap length Ls section is longer.

In the state shown in FIG. 23C, the compression chamber has moved toward the center, further shortening its length in the rotating axis direction. Moreover, the wrap length Ll section disappears, leaving a rectangular shape having a uniform width (wrap length Ls).

In the minimum capacity state shown in FIG. 23D, the shape of the compression chamber is rectangular having a uniform width, as in the state of FIG. 23C, but the length of the compression chamber in the rotating axis direction is shorter than in FIG. 23C. Thereafter, the discharge valve 26 is opened and the fluid is discharged.

In the scroll compressor described above, change in the capacity of the compression chamber is not caused only by decrease in the cross-sectional capacity which is parallel to the revolving face, but is caused in multiple by decrease in the width of the revolving face and decrease in the cross-sectional capacity, as shown in FIG. 7.

Therefore, when the wrap lengths of the wall bodies 12*b* and 13*b* near the outer side and center of the scroll compressor mechanism are changed so as to provide steps in the wall bodies 12*b* and 13*b*, increasing the maximum capacity and decreasing the minimum capacity of the compression chamber C, a higher compression ratio can be obtained than in the conventional scroll compressor where the wrap lengths of the wall bodies is constant.

Furthermore, in the scroll compressor described above, internal pressure of the compression chamber C0, positioned on the center side, is led through the join path 40 between the groove 121 and the tip seal 27*d*, and internal pressure of the compression chamber C0, positioned on the center side, is led through the join path 41 between the groove 131 and the tip seal 28*d*. At this time, since the internal pressure of the compression chambers C0, positioned on the center side, are much greater than the internal pressure of the compression chambers C0, positioned on the outer end side. This pressure increases the pushing force of the tip members 27*d* and 28*d*, enabling them to function adequately as seals. Consequently, since leakage of the fluid from the compression chambers C is prevented, there is no need for a recompression dynamic force to compensate for leaked fluid, eliminating dynamic force loss of the drive power and increasing the operating efficiency.

Figure 24:
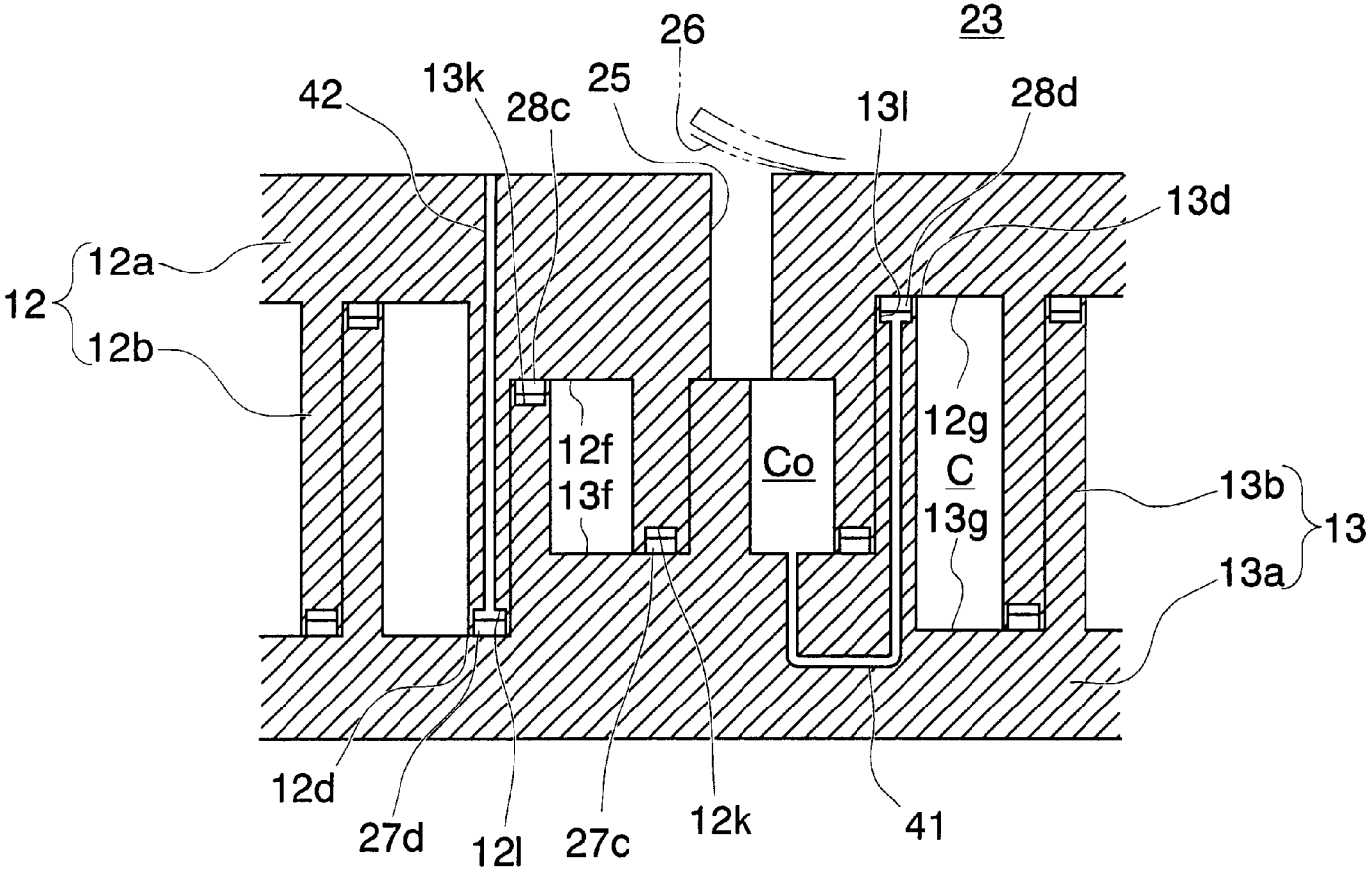
FIG. 24 is a diagram showing an eleventh embodiment of the scroll compressor according to the present invention, being a cross-sectional view of a scroll compressor as mechanism.

Subsequently, an eleventh embodiment of the scroll compressor according to the present invention will be explained with reference to FIG. 24. Components which are identical to those in the first embodiment are represented by the same reference codes and those explanations are omitted.

In the eleventh embodiment, a join path 42 applies pressure to the tip seal 27*d* on the fixed scroll 12 side, and joins to the discharge cavity 23 instead of the compression chamber C.

The discharge cavity 23 connects to the compression chamber C, where most compression has taken place, and consequently has the same internal pressure. Therefore, the same effects are obtained as in the tenth embodiment, in which the lead path 40 joined the compression chamber C to the groove 121.

Subsequently, an eleventh embodiment of the scroll compressor according to the present invention will be explained with reference to FIGS. 25A and 25B. Components which are identical to those in the first embodiment are represented by the same reference codes and those explanations are omitted.

Figure 25A:
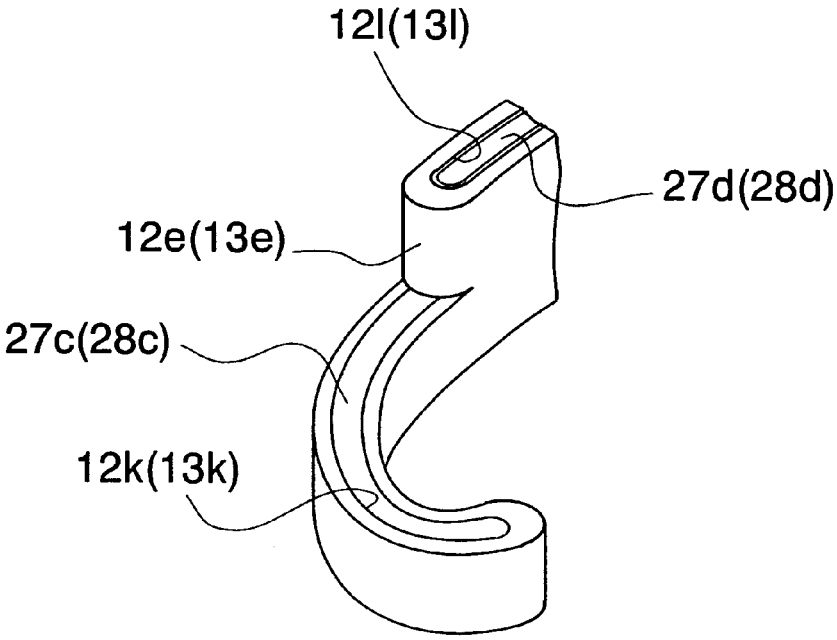
FIG. 25A is a diagram showing a twelfth embodiment of a scroll compressor according to the present invention, being a perspective view of the step of the fixed scroll.
Figure 25B:
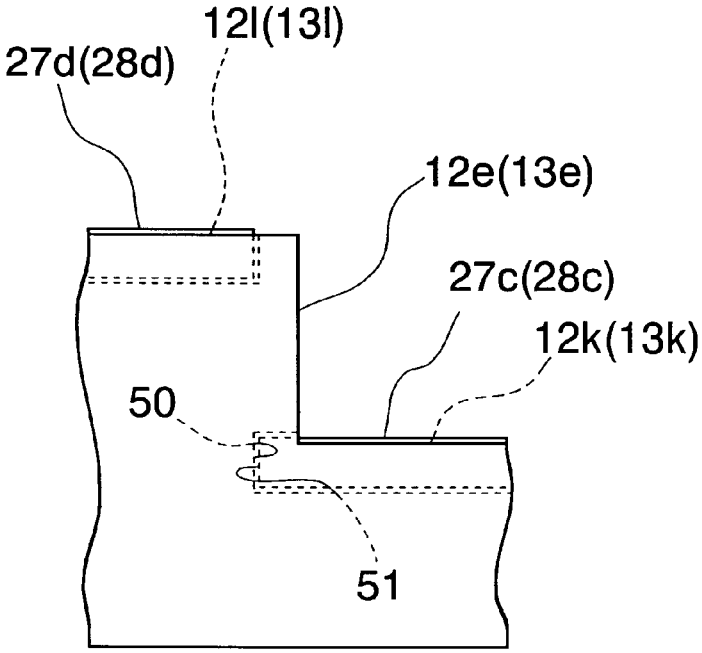
FIG. 25B is a plan view of the step of the fixed scroll from the side.

In this embodiment, as shown in FIGS. 25A and 25B, only tip seals 27*c* and 27*d* are provided while the tip seal 27*e* is not provided. The join edge 12*e*, the tip seal 27*d*, and the groove 121 are the same as FIGS. 19A to 19E in their shapes.

The groove 12*k*, in which the tip seal 27*c* is engaged, extends in the outer spiral direction to the join edge 12*e* and connects to the concavity 50, which is provided in the outer spiral direction than the join edge 12*e*, along the spiral direction. The tip seal 27*c* is extended along the shape of the groove 12*k* and the end portion 51 of the tip seal 27*c* is engaged in the concavity 50. In the swiveling scroll 13, the same constitution is provided.

In this constitution, since the end portion 51 of the tip seal 27*c* is engaged in the concavity 50, the tip seal 27*c* dons not fall off from the groove 12*k* even if the join edge 12*e* and the join wall face 13*h* are separated, increasing reliability. Furthermore, in the constitution, since a tip seal is not provided in the join edge 12*e*, the constitution is not suitable if high compression ratio achieves by providing the difference between lower and higher top edges at the step, however, if not, it is preferable that its processes and assembling are simple, increasing productivity and reducing cost.

What is claimed is:

1. A scroll compressor comprising:

a fixed scroll, which is fixed in position and has a spiral-shaped wall body on one side face of an end plate;

a swiveling scroll, which has a spiral-shaped wall body on one side face of an end plate, being supported by engaging of the wall bodies so as to move revolution swiveling as it is prevented rotating;

top edges of the wall bodies being divided at a plurality of points, the height at each point becoming low on the center side of the spiral direction and becoming high on the outer side, thereby forming a step; and one side face of the end plates similarly being divided at a plurality of points, the height at each point becoming high on the center side of the spiral direction and becoming low on the outer side, thereby forming a step in correspondence with each of the points; the scroll compressor comprising a sealing member being provided on a join edge which joins adjacent points on the top edges and sliding against a join wall face which joins adjacent points on the side faces of the end plates; and a sealing member holding unit which prevents the sealing member from falling off a scroll member.

2. The scroll compressor as described in claim 1, wherein the sealing member holding unit comprising a groove provided in the join edge;

a filling section provided in the sealing member to be fitted into the groove;

a narrower section provided at the opening of the groove and having a narrower width than the bottom section of the groove; and an enlarged section provided on the filling section and clipping into the narrower section so as to prevent the filling section from becoming removed from the groove.

3. The scroll compressor as described in claim 1, the sealing member holding unit is a groove provided in the join edge, wherein the sealing member to be engaged in the groove connecting to at least one other sealing member which is engaged into the groove provided along each of the top edges, and engaging another end of the sealing member therein.

4. The scroll compressor as described in claim 1, the sealing member holding unit comprising a groove provided in the join edge;

a concavity which connects to the groove; and a convexity provided on the sealing member which is engaged into the groove with movable space.

5. The scroll compressor as described in any one of claims 2, 3, and 4, wherein an elastic material for applying a pressing force in the direction of the separation of the sealing member, provided in the groove, from the join edge, is provided to the groove.

6. The scroll compressor as described in claim 1, the sealing member holding unit comprising an elastic material, which is provided between the sealing member and the scroll member and connects the two members together.

7. The scroll compressor as described in any one of claims 1, 2, 3, and 4, the dimensions of the sealing member at the time of its formation being set so that the tip of the sealing member touches the side wall of another scroll member when assembled with the other scroll member.

8. The scroll compressor as described in any one of claims 1, 2, 3, 4, and 6, the sealing member comprising a polymer material.

* * * * *